US011385578B2

(12) United States Patent
Yokoyama

(10) Patent No.: US 11,385,578 B2
(45) Date of Patent: Jul. 12, 2022

(54) IMAGE FORMING APPARATUS

(71) Applicant: CANON KABUSHIKI KAISHA, Tokyo (JP)

(72) Inventor: Masashi Yokoyama, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/382,135

(22) Filed: Jul. 21, 2021

(65) Prior Publication Data

US 2022/0035282 A1 Feb. 3, 2022

(30) Foreign Application Priority Data

Jul. 29, 2020 (JP) ..... JP2020-128078
May 28, 2021 (JP) ..... JP2021-090149

(51) Int. Cl.
*G03G 15/20* (2006.01)
*G03G 15/16* (2006.01)

(52) U.S. Cl.
CPC ..... *G03G 15/2028* (2013.01); *G03G 15/1615* (2013.01); *G03G 15/205* (2013.01); *G03G 15/2064* (2013.01); *G03G 2215/00156* (2013.01); *G03G 2215/2032* (2013.01)

(58) Field of Classification Search
CPC ..... G03G 15/2028; G03G 15/1615; G03G 15/205; G03G 15/2064
See application file for complete search history.

(56) References Cited

FOREIGN PATENT DOCUMENTS

JP 2009181055 A 8/2009

*Primary Examiner* — Sevan A Aydin
(74) *Attorney, Agent, or Firm* — Canon U.S.A., Inc. I.P. Division

(57) ABSTRACT

An image forming apparatus having a fixing unit, a belt, a conveyance unit, a heat sink, first and second rollers, a belt position detection unit, a steering unit, and a control unit further includes an image forming unit to form a toner image on a recording material, and perform a state transition to a power-off state and to a standby state where image forming by the image forming unit is possible. The belt position detection unit detects a position of the belt. The steering unit swings the first roller relative to the second roller based on a detection result by the belt position detection unit to widthwisely move the belt relative to the first roller. When the image forming apparatus enters the power-off state, the control unit controls the steering unit to make a rotational axis of the first roller approximately parallel to a rotational axis of the second roller.

11 Claims, 14 Drawing Sheets

IMAGE FORMING APPARATUS

BACKGROUND

Field

The present disclosure relates to an image forming apparatus such as a printer, a copying machine, a facsimile, and a multifunction peripheral. More particularly, the present disclosure relates to an image forming apparatus having a fixing apparatus for fixing a toner image to a recording material, and a recording material cooling apparatus for cooling down the recording material discharged from the fixing apparatus.

Description of the Related Art

A conventional image forming apparatus for forming an image on a recording material employs a belt conveyance apparatus that nips and conveys a recording material by using an endless belt (hereinafter simply referred to as a belt) stretched around a plurality of rollers. For example, there is proposed a recording material cooling apparatus that cools down a belt that is nipping and conveying a recording material conveyed from a fixing apparatus to lower the temperature of the recording material with a toner image fixed thereon, via the cooled belt, thus preventing adhesion between recording materials to be stacked as discussed in Japanese Patent Application Laid-Open No. 2009-181055.

The recording material cooling apparatus using a belt, as discussed in Japanese Patent Application Laid-Open No. 2009-181055, performs steering control in which at least one of a plurality of rollers for suspending the belt is inclined to reciprocate the belt in the roller axis direction, thus preventing the belt from shifting all the way to an end of the roller. The recording material cooling apparatus constantly performs such steering control while the belt is rotating, and stops the steering control when stopping rotating the belt. Accordingly, the roller may stop in an inclined state depending on the timing of stopping the steering control.

A recording material cooling apparatus using a belt requires a periodical belt replacement for maintenance. There has been an issue that the belt is difficult to be replaced if the roller stops in an inclined state as described above.

In particular, when the roller is stopping at a position where the roller inclines to move the belt toward the back side, as illustrated in FIG. 13, the pressure applied to the front side in the roller axis direction has been increased to move the belt toward the back side in the roller axis direction. If an attempt is made in this state to pull out the belt from the front side in the roller axis direction, the belt will be caught on the front side, making it difficult to replace the belt.

SUMMARY

According to an aspect of the present disclosure, an image forming apparatus including an image forming unit configured to form a toner image on a recording material, and configured to perform a state transition to a power-off state and to a standby state where image forming by the image forming unit is possible, includes a fixing unit configured to fix the toner image on the recording material, a belt, a conveyance unit configured to form a conveyance nip portion with the belt and to nip and convey the recording material that has passed through the fixing unit, a heat sink configured to be in contact with an inner circumferential surface of the belt, first and second rollers configured to suspend the belt, each having a rotational axis, a belt position detection unit configured to detect a position of the belt in a widthwise direction perpendicular to a thickness direction of the belt and a conveyance direction of the recording material nipped by the conveyance nip portion, a steering unit configured to swing the first roller relative to the second roller based on a detection result by the belt position detection unit to widthwisely move the belt relative to the first roller, and a control unit configured to control the steering unit, wherein, when the image forming apparatus enters the power-off state, the control unit controls the steering unit to make the rotational axis of the first roller approximately parallel to the rotational axis of the second roller.

Further features of the present disclosure will become apparent from the following description of exemplary embodiments with reference to the attached drawings.

BRIEF DESCRIPTION OF THE DRAWINGS

FIG. 11 is a flowchart illustrating the steering roller control when power of the cooling apparatus according to the exemplary embodiment is ON.

DESCRIPTION OF THE EMBODIMENTS

<Image Forming Apparatus>

Figure 1:
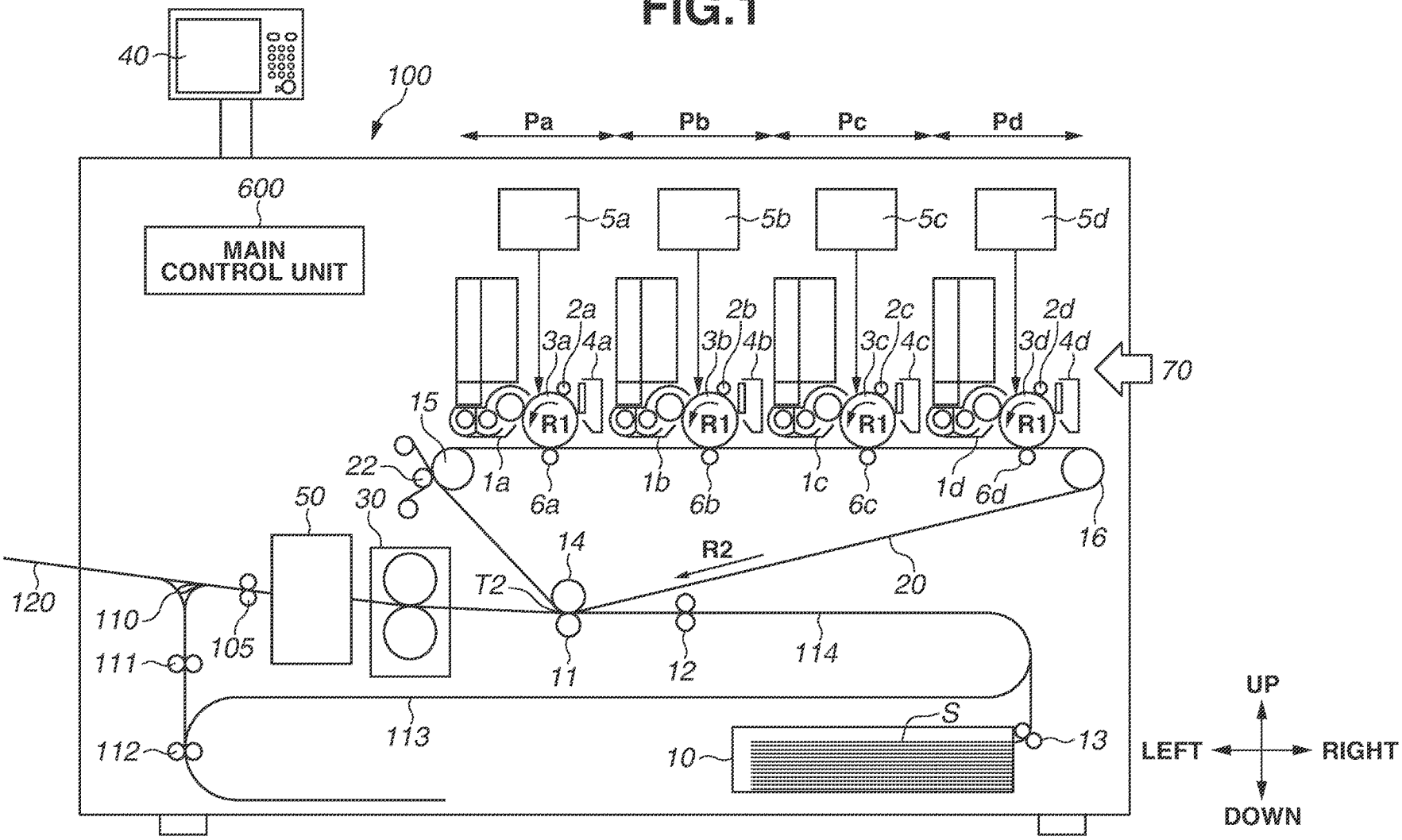
FIG. 1 is a cross-sectional view illustrating an image forming apparatus according to an exemplary embodiment.

An exemplary embodiment of the present disclosure will be described below with reference to the accompanying drawings. An image forming apparatus to which a cooling apparatus according to the present exemplary embodiment is applicable will be described with reference to FIG. 1. An image forming apparatus 100 illustrated in FIG. 1 is an electrophotographic tandem type full color printer. The image forming apparatus 100 includes image forming units Pa, Pb, Pc, and Pd for forming a yellow, a magenta, a cyan, and a black image, respectively. The image forming apparatus 100 forms a toner image on a recording material S according to image information from a document reading apparatus (not illustrated) or an external apparatus (not illustrated), such as a personal computer, communicably connected to the image forming apparatus 100. Examples of recording materials S include plain paper, thick paper, rough paper, uneven paper, coated paper, and other types of paper, and include plastics films, cloths, and other various types of sheet materials.

A recording material conveyance process of the image forming apparatus 100 will be described. Recording materials S are stored in a paper cassette 10 in a stacked manner Each of the recording materials S is sent out from the paper cassette 10 by a feed roller 13 in synchronization with the image forming timing. The recording material S sent out by the feed roller 13 is conveyed to a registration roller 12 disposed in the middle of a conveyance path 114. Then, the recording material S is subjected to skew correction and timing correction by the registration roller 12 and then sent to a secondary transfer portion T2. The secondary transfer portion T2 is a transfer nip portion formed by a secondary inner transfer roller 14 and a secondary outer transfer roller 11. At the secondary transfer portion T2, a toner image is transferred to the recording material S by a secondary transfer voltage being applied to the secondary outer transfer roller 11.

The process of conveying the recording material S to the secondary transfer portion T2 has been described above. The process of forming an image transmitted to the secondary transfer portion T2 at a similar timing will be described. Firstly, the image forming units will be described. The image forming units Pa, Pb, Pc, and Pd have approximately similar configurations except for the colors of the used toner. More specifically, the image forming units Pa, Pb, Pc, and Pd use yellow, magenta, cyan, and black toner, respectively. The image forming unit Pd for black will be described as a representative, and descriptions of other image forming units Pa, Pb, and Pc will be omitted.

The image forming unit Pd mainly includes a development unit 1*d*, a charging unit 2*d*, a photosensitive drum 3*d*, a photosensitive drum cleaner 4*d*, and an exposure unit 5*d*. Referring to FIG. 1, the surface of the photosensitive drum 3*d* rotating in the direction of the arrow R1 is uniformly pre-charged by the charging unit 2*d*. Then, an electrostatic latent image is formed on the photosensitive drum 3*d* by the exposure unit 5*d* driven based on an image information signal. Next, the electrostatic latent image formed on the photosensitive drum 3*d* is developed into a toner image by using developer by the development unit 1*d*. Then, when a primary transfer voltage is applied to a primary transfer roller 6*d* disposed across the image forming unit Pd and the intermediate transfer belt 20, the toner image formed on the photosensitive drum 3*d* is primarily transferred onto an intermediate transfer belt 20. A small amount of primary transfer residual toner on the photosensitive drum 3*d* is collected by the photosensitive drum cleaner 4*d*, and then the image forming unit Pd prepares for the next image forming process again.

In the above-described conveyance and image forming processes, timing is synchronized between the recording material S and the full color toner image at the secondary transfer portion T2, and then secondary transfer is performed. Subsequently, the recording material S is conveyed to the fixing apparatus 30 and applied with a predetermined pressure and heat, and the toner image is fixed onto the recording material S. The fixing apparatus 30 nips and conveys the recording material S with a toner image formed thereon, and then heats and pressurizes the conveyed recording material S to fix the toner image to the recording material S. More specifically, toner of the toner images formed on the recording material S through heating and pressurization is melted and mixed, and then the toner images are fixed on the recording material S as a full color image. In this way, a series of image forming processes ends. According to the present exemplary embodiment, the image forming units Pa, Pb, Pc, and Pd, the intermediate transfer belt 20, the secondary inner transfer roller 14, and the secondary outer transfer roller 11 are an example of an image forming unit for forming an image on the recording material S by using toner.

According to the present exemplary embodiment, the recording material S with a toner image fixed thereon is conveyed from the fixing apparatus 30 to the recording material cooling apparatus 50 and then cooled. For example, the temperature of the recording material S is around 90° C. immediately before entering the recording material cooling apparatus 50, and decreases to around 60° C. after exiting the recording material cooling apparatus 50. The recording material cooling apparatus 50 will be described in detail below.

In single-sided image forming, the recording material S with a toner image fixed thereon is nipped and conveyed by a discharge roller pair 105 and then discharged on a discharge tray 120. On the other hand, in double-sided image forming, the conveyance path is changed from the path leading to the discharge tray 120 to a double-sided conveyance path 111 by a switching member 110 (flapper), and the recording material S nipped and conveyed by the discharge roller pair 105 is sent to the double-sided conveyance path 111. Subsequently, the leading and trailing ends are exchanged by a reversing roller 112 and then sent to the conveyance path 114 again via a double-sided path 113. The subsequent conveyance and image forming processes for the rear surface (second surface) are similar to the above-described processes, and redundant descriptions thereof will be omitted.

Figure 2:
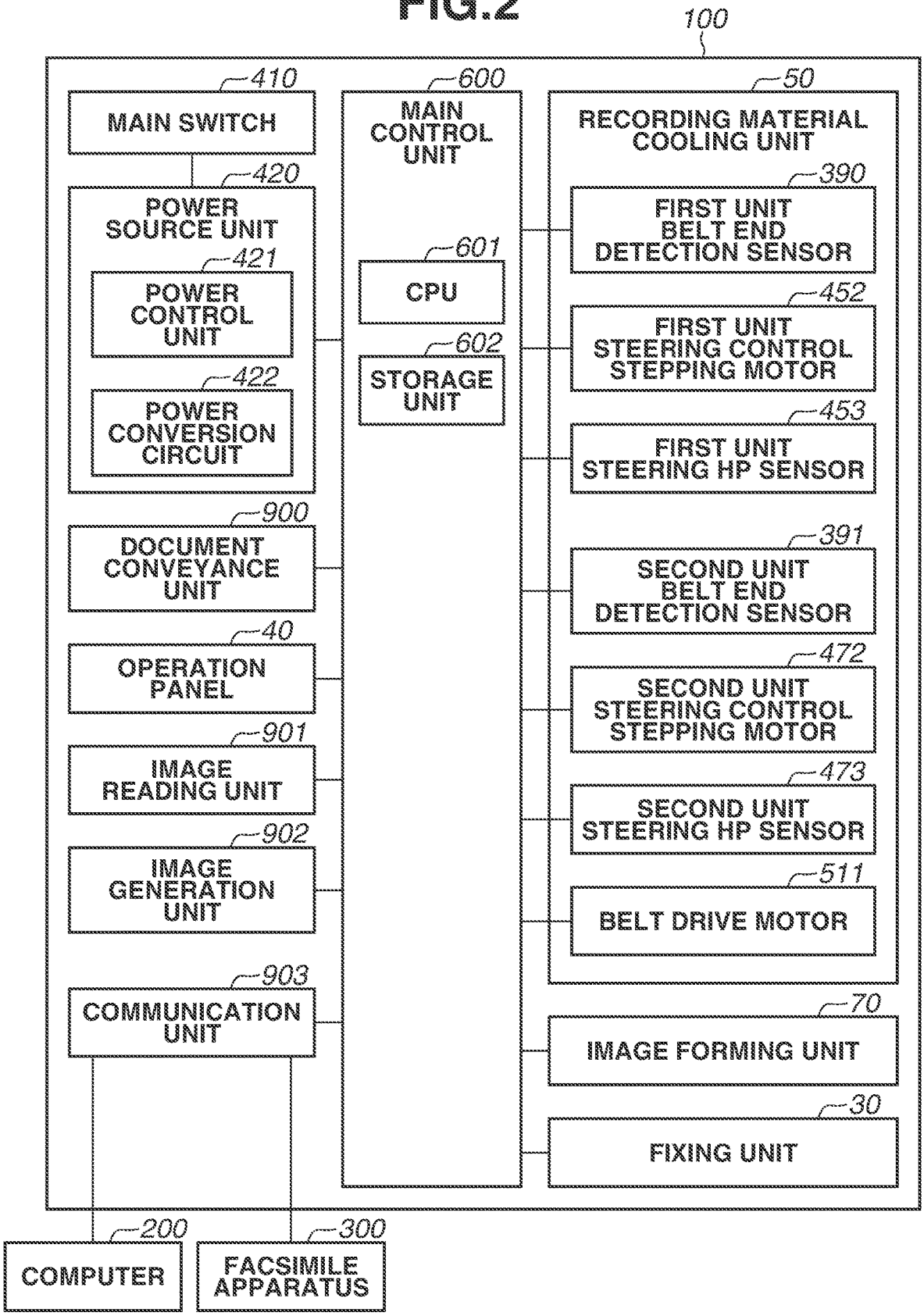
FIG. 2 is a block diagram illustrating an example hardware configuration of the image forming apparatus according to the exemplary embodiment.

An example hardware configuration of the image forming apparatus 100 according to the present exemplary embodiment will be described below with reference to FIG. 2. FIG. 2 is a block diagram illustrating an example hardware configuration of the image forming apparatus 100 according to the present exemplary embodiment.

The image forming apparatus 100 includes a main control unit 600 as a portion for controlling the operations of the image forming apparatus 100. For example, the main control unit 600 is a substrate having a central processing unit (CPU) 601 as a control element. The main control unit 600 collectively controls the entire image forming apparatus 100. The main control unit 600 performs turning on/off and the like of a portion for controlling the entire apparatus, a portion for controlling communication, a portion for performing image processing, a portion for image forming, and a motor for rotating various rotating members. The main control unit 600 may be divided into a plurality of different control units for respective functions, for example, an engine control unit for controlling printing. In the following descriptions, these control units are collectively configured. The main control unit 600 is an example of a control unit.

The main control unit 600 includes a storage unit 602 that stores programs and data for controlling the image forming apparatus 100 as well as image data. For example, the storage unit 602 includes a combination of volatile and nonvolatile storage devices, including a random access memory (RAM), a read only memory (ROM), a hard disk drive (HDD), and a flash ROM. The CPU 601 performs calculation processing, and transmits and receives control signals based on programs and data stored in the storage unit 602, to control the image forming apparatus 100. Paper type settings such as plain paper and coated paper input from the operation panel 40 by the user are also stored in the storage unit 602 by the CPU 601.

The main control unit 600 is communicably connected to a document conveyance unit 900, an image reading unit 901, and other units of the image forming apparatus 100 to control each unit. The main control unit 600 is also communicably connected with the operation panel 40. In this way, settings and inputs made on the operation panel 40 are transmitted to the main control unit 600. The main control unit 600 issues operation instructions to respective units according to the settings to operate each unit of the image forming apparatus 100.

The main control unit 600 is further connected with a communication unit 903, which is as an interface for communicating with a computer 200 (e.g., a personal computer) and a remote facsimile apparatus 300 via a network, a cable, or a communication network. Thus, the image forming apparatus 100 receives image data from the computer 200 and performs printing (printer function). Image data read by the image reading unit 901 is accumulated in the storage unit 602 and then transmitted to the computer 200 (scanner function). Image data is also transmitted and received to/from the external facsimile apparatus 300 (facsimile function).

The image forming apparatus 100 is provided with a power source unit 420. For example, the power source unit 420 is connected to a commercial power supply to generate various voltages. A main switch 410 for turning ON and OFF the main power source for connecting and disconnecting the commercial power supply and the power source unit 420 is provided (e.g., on the side face of the image forming apparatus 100). The main switch 410 can be operated by a user or service engineer. The operation for turning the main switch 410 OFF from ON serves as a trigger for shifting the image forming apparatus 100 to the power OFF state. The operation for turning the main switch 410 ON from OFF serves as a trigger for shifting the image forming apparatus 100 to the standby state.

The power source unit 420 includes a plurality of power conversion circuits 422 including, for example, a rectifier circuit, a transformer, a converter, and a smoothing circuit to generate a plurality of different voltages required to operate the image forming apparatus 100. For example, the power source unit 420 generates 24 VDC for motor drive and 5 VDC and 3.3 VDC for driving circuit elements such as the main control unit 600, and applies these voltages to the units of the image forming apparatus 100.

When the image reading unit 901, the image generation unit 902, and other units of the image forming apparatus 100 do not operate for a predetermined time period, the main control unit 600 enters a power-saving state providing a smaller power consumption than a standby state that can immediately start the image forming operation upon reception of an image forming instruction. Then, the main control unit 600 stops supplying power to portions predetermined by a power control unit 421, thus implementing power-saving. According to the present exemplary embodiment, the main control unit 600 monitors the image reading unit 901, the image generation unit 902, and other units of the image forming apparatus 100 and then enters the power-saving state. However, the monitoring targets are not limited thereto. The main control unit 600 may follow an instruction for entering the power-saving state from the operation panel 40. The present exemplary embodiment has been described above centering on the image forming apparatus 100 capable of performing state transitions to three different states: the power-off state, the power-saving state, and the standby state. However, the image forming apparatus 100 may have two different power-saving states.

<Recording Material Cooling Apparatus>

Figure 3:
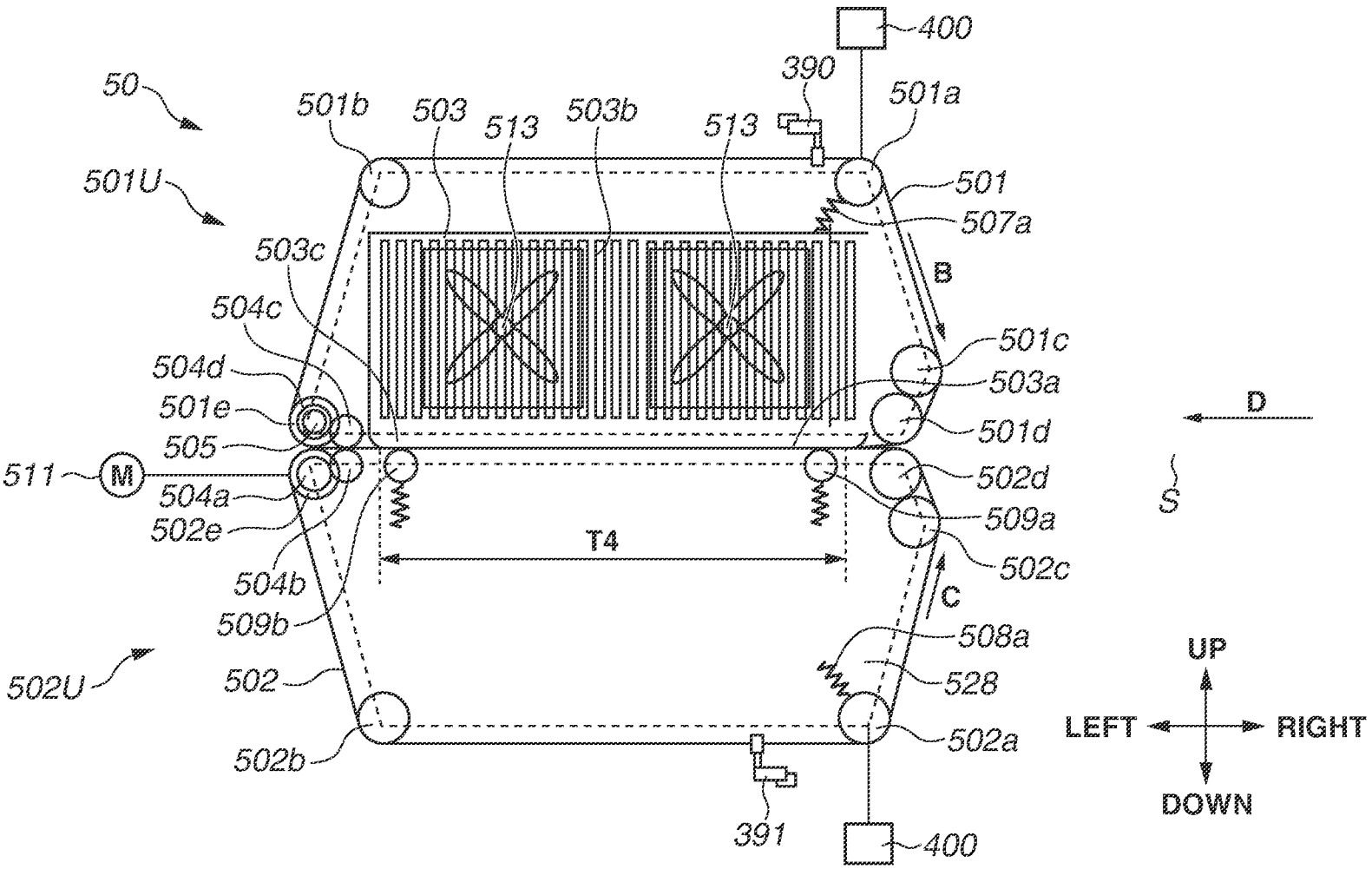
FIG. 3 illustrates a cooling apparatus according to the exemplary embodiment.

Next, the recording material cooling apparatus 50 will be described with reference to FIG. 3. As illustrated in FIG. 3, the recording material cooling apparatus 50 includes a first unit 501 U having an endless first belt 501, and a second unit 502 U having an endless second belt 502 for nipping with the first belt 501 and conveying the recording material S. For example, the first belt 501 and the second belt 502 are made of polyimide having high strength. These belts are set to 100 μm in thickness and 942 mm in circumference. The recording material cooling apparatus 50 includes a heat sink 503 for cooling down the first belt 501. The heat sink 503 is an example of a cooling member for cooling down the first belt 501.

According to the present exemplary embodiment, the heat sink 503 contacts the first belt 501 that is in contact with the recording material S on the surface where a toner image is formed at the secondary transfer portion T2 (see FIG. 1).

The first belt 501 is stretched around a plurality of the first belt suspension rollers 501*a* to 501*e*. Either one of the first belt suspension rollers 501*a* to 501*e* is rotated by a belt drive motor 511. The second belt 502 is stretched around a plurality of the second belt suspension rollers 502*a* to 502*e*. Either one of the second belt suspension rollers 502*a* to 502*e* is rotated by the belt drive motor 511. More specifically, the first belt 501 is suspended by the first belt suspension rollers 501*a* to 501*e*, and the second belt 502 is suspended by the second belt suspension rollers 502*a* to 502*e*.

According to the present exemplary embodiment, the second belt suspension roller 502*e* rotated by the belt drive motor 511 corresponds to a drive roller for driving the second belt 502. For example, the second belt suspension roller 502*e* is composed of an aluminum roller with a diameter of 24.8 mm, and silicon rubber with a thickness of 100 μm formed on the outer circumferential surface of the roller, with the friction coefficient for the polyimide belt set to 1.1. In this way, the second belt 502 rotates in the direction of the arrow C in FIG. 3.

A drive train 504*a* is disposed at a shaft end portion of the second belt suspension roller 502*e*. Drive trains 504*a* to 504*d* transmit a driving force to the first belt 501. According to the present exemplary embodiment, the second belt suspension rollers 502*a* to 502*d* correspond to idler rollers for suspending the second belt 502. For example, the second belt suspension rollers 502*a* to 502*d* are aluminum rollers with a diameter of 25 mm, with the friction coefficient for the polyimide belt set to 0.1. On the other hand, the first belt 501 is stretched around the plurality of the first belt suspension rollers 501*a* to 501*e* and is in contact with the second belt 502.

At least either one of the first belt suspension rollers 501*a* to 501*e* is rotated by a driving force of the belt drive motor 511 via the drive trains 504*a* to 504*d*. According to the present exemplary embodiment, the first belt suspension roller 501*e* rotated by the drive train 504*d* corresponds to a drive roller for driving the first belt 501. For example, the first belt suspension roller 501*e* is composed of an aluminum roller with a diameter of 24.8 mm, and silicon rubber with a thickness of 100 μm formed on the outer circumferential surface of the roller, with the friction coefficient for the polyimide belt set to 1.1. In this way, the first belt 501 rotates in the direction of the arrow B in FIG. 3.

In this way, the first belt 501 and the second belt 502 are rotated in the same direction at a cooling nip portion T4 by the belt drive motor 511 as the same drive source. According to the present exemplary embodiment, the second belt suspension rollers 502*a* to 502*d* correspond to idler rollers for suspending the second belt 502. For example, the second belt suspension rollers 502*a* to 502*d* are aluminum rollers with a diameter of 25 mm, with the friction coefficient for the polyimide belt set to 0.1. In addition, the first belt suspension roller 501*e* and the second belt suspension roller 502*e* do not form a nip portion.

The drive trains 504*a* to 504*d* are gears. Any one of the drive trains 504*a* to 504*d* has a one-way clutch 505 that disconnects the driving force transmission depending on the driving force direction. According to the present exemplary embodiment, the one-way clutch 505 is embedded in the drive train 504*d*, and the rotation shaft of the drive train 504*d* and the rotation shaft of the one-way clutch 505 are coaxially positioned.

Setting is made so that, when the first belt suspension roller 501*e* is rotated clockwise in FIG. 3, the one-way clutch 505 is not locked with the shaft end portion of the first belt suspension roller 501*e*. For example, when the rotating belt drive motor 511 is rotated to rotate the second belt 502 in the direction of the arrow C in FIG. 3, the drive train 504*a* rotates counterclockwise in FIG. 3, the drive train 504*b* rotates clockwise in FIG. 3, the drive train 504*c* rotates counterclockwise in FIG. 3, and the drive train 504*d* rotates clockwise in FIG. 3.

When the drive train 504*d* rotates clockwise, the one-way clutch 505 locks with the shaft end portion of the first belt suspension roller 501*e*, and the first belt suspension roller 501*e* rotates clockwise. When the first belt suspension roller 501*e* rotates clockwise, the first belt 501 rotates in the direction of the arrow B in FIG. 3.

The recording material cooling apparatus 50 will be described with reference to FIGS. 4 and 5. The first unit 501 U for suspending the first belt 501 by the first belt suspension rollers 501*a* to 501*e* and the second unit 502 U for suspending the second belt 502 by the second belt suspension rollers 502*a* to 502*e* form the cooling nip portion T4. The cooling nip portion T4 is an example of a conveyance nip portion that nips and conveys a sheet.

<Fixing Apparatus>

The second unit 502 U includes the drive train 504*a* rotatably supported by a shaft end portion of the second belt suspension roller 502*e* via a bearing (not illustrated), and a rotation support member 506. The rotation support member 506 is provided with a second idler shaft 507 fixed thereto, and the second idler shaft 507 is provided with the drive train 504*b* rotatably supported via a bearing (not illustrated). The drive trains 504*a* and 504*b* are disposed to transmit a driving force.

The first unit 501 U includes a first idler shaft 512 fixed thereto, and the drive train 504*c* rotatably supported by the first idler shaft 512 via a bearing (not illustrated). A shaft end portion of the first belt suspension roller 501*e* is provided with the drive train 504*d* rotatably supported via the one-way clutch 505 illustrated in FIG. 1. The drive trains 504*c* and 504*d* are disposed to transmit a driving force.

According to the present exemplary embodiment, the first belt suspension roller (also referred to as a steering roller) 501*a* and the second belt suspension roller (also referred to as a steering roller) 502*a* are steering rollers disposed to control the deviations of the first belt 501 and the second belt 502, respectively. For example, the steering roller 501*a* is composed of an aluminum roller with a diameter of 24.8 mm, and an acrylic layer with a thickness of 100 μm formed on the outer circumferential surface of the roller, with the friction coefficient for the polyimide belt set to 0.5. These steering rollers 501*a* and 502*a* press the first belt 501 and the second belt 502, respectively, from the inner circumferential side outward so that the first belt 501 and the second belt 502 provide a tension of about 39.2 N (about 4 kgf).

To accomplish this, the steering roller (second belt suspension roller) 501*a* is biased by a spring 507*a* (see FIG. 3), and the steering roller 502*a* is biased by a spring 508*a* (see FIG. 3).

Figure 7A:
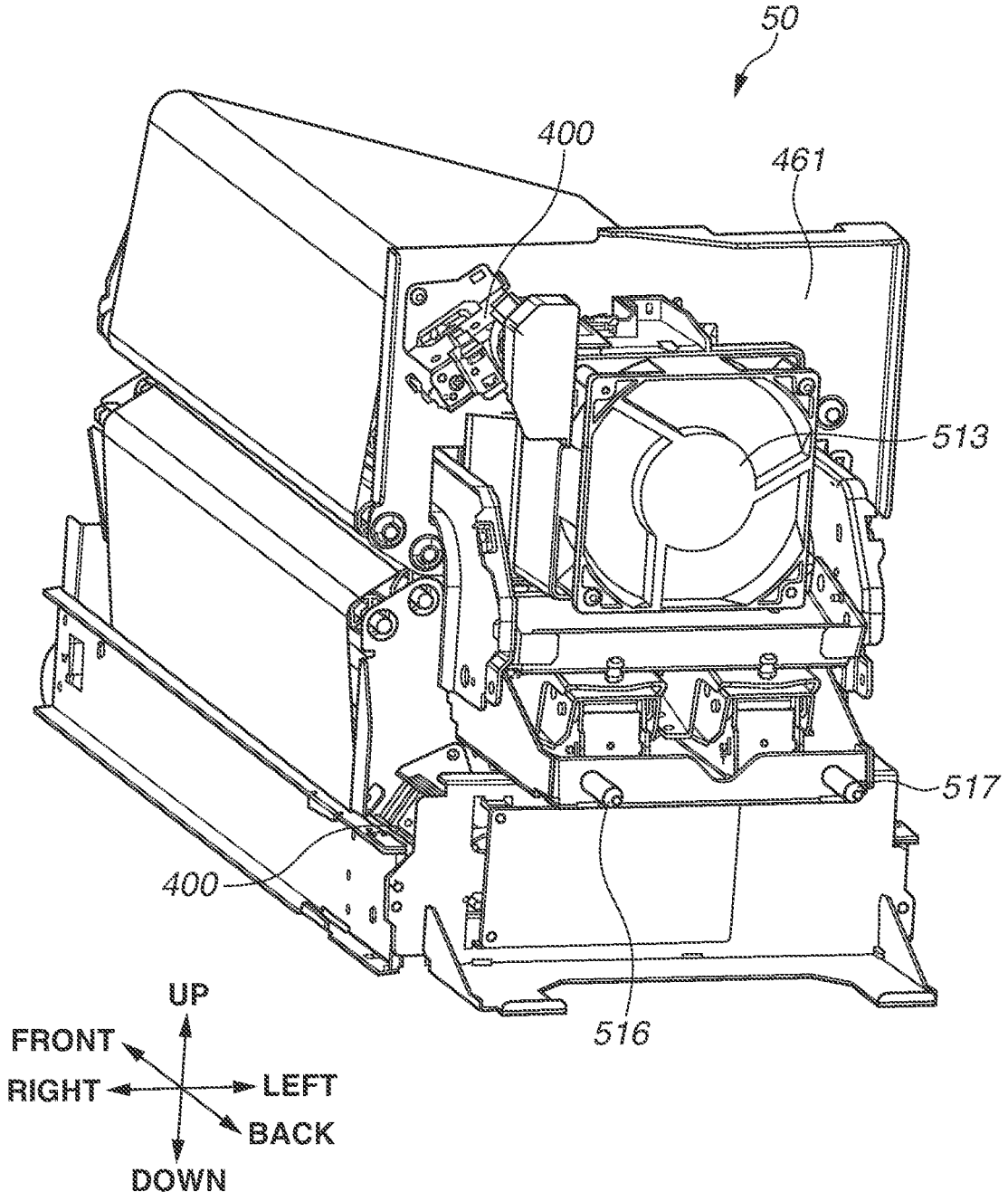
FIGS. 7A and 7B illustrate the cooling apparatus according to the exemplary embodiment.
Figure 7B:
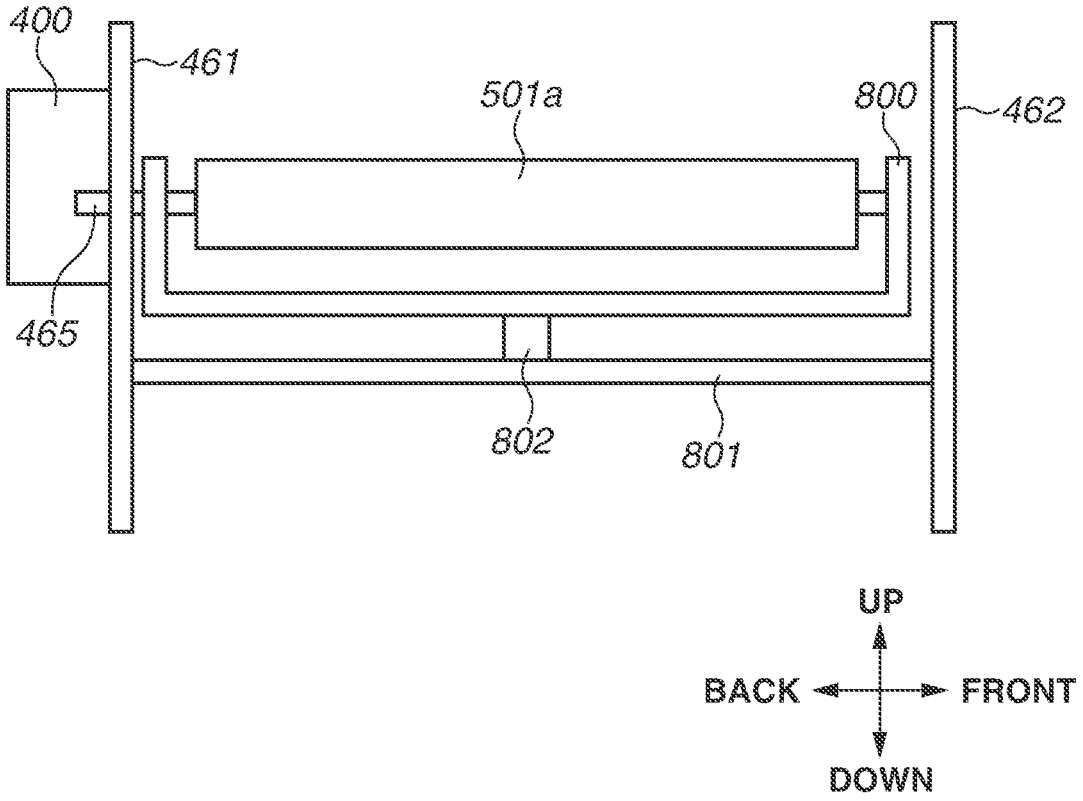

FIG. 7A is a perspective view illustrating the recording material cooling apparatus 50 viewed from the back side (rear surface side) of the image forming apparatus 100. FIG. 7B is a cross-sectional view schematically illustrating the steering roller 501*a*. As for each of the steering rollers 501*a* and 502*a*, steering mechanisms 400 are provided on the back side of the recording material cooling apparatus 50, as illustrated in FIG. 7A. When the steering rollers 501*a* and 502*a* are swung around the center thereof in the rotational axis direction (widthwise direction), steering control of the first belt 501 and the second belt 502 can be performed. The steering mechanisms 400 are examples of steering units.

As illustrated in FIG. 7B, the steering roller 501*a* is rotatably supported by a roller holder 800. The roller holder 800 is swingable around a swing axis 802 relative to a support sheet metal 801. The swing axis 802 is provided at the center between the front and the back side ends of the roller holder 800 in the rotational axis direction of the steering roller 501*a*. When a shaft 465 fixed to the roller holder 800 is operated by a steering mechanism 400, the roller holder 800 is swingable around the swing axis 802. The support sheet metal 801 is supported by a back side plate 461 disposed on the back side of the recording material cooling apparatus 5 and a front side plate 462 disposed on the front side thereof. When an operation lever (not illustrated) is operated, the support sheet metal 801 moves the steering roller 501*a* toward the inner circumferential side together with the roller holder 800, thus releasing the pressing of the steering roller 501*a* on the first belt 501. In other words, this operation enables canceling the state where the first belt 501 is suspended with tension. The steering roller 501*a* has been described above as an example. The steering roller 502*a* of the second unit 502 U has a similar configuration to the steering roller 501*a*.

Although the present exemplary embodiment will be described centering on an example configuration in which the steering mechanisms 400 are disposed in the recording material cooling apparatus 50, the steering mechanisms 400 may be disposed on the frame (not illustrated) of the image forming apparatus 100 that supports the recording material cooling apparatus 50. Steering control of the first belt 501 and the second belt 502 will be described below. Although, in the above-described exemplary embodiment, the steering mechanism 400 is configured to be operated by the shaft 465 disposed on the roller holder 800, the steering mechanism 400 may be directly operated by the axis of the steering roller 501*a* to perform steering control.

According to the present exemplary embodiment, the steering rollers 501*a* and 502*a* are examples of first rollers, and the first belt suspension rollers 501*b* to 501*e* and the second belt suspension rollers 502*b* to 502*e* are examples of second rollers. As described above, according to the present exemplary embodiment, the first belt suspension rollers 501*b* to 501*e* and the second belt suspension roller 52*b* to 502*e* do not swing, and both ends of the roller axes are supported by the front and the back side frames of the first unit 501 U and the second unit 502 U. The steering roller 502*a* is an example of a third roller, and the second belt suspension rollers 502*b* to 502*e* are examples of fourth rollers.

Pressure rollers 509*a* and 509*b* for pressurizing the second belt 502 toward the heat sink 503 are disposed on the inner circumferential side of the second belt 502. For example, the pressure rollers 509*a* and 509*b* apply a pressure of 9.8 N (1 kgf) to the second belt 502 to reliably bring the first belt 501 to contact the heat sink 503 (heat reception unit 503*a* to be described below) via the second belt 502.

The recording material S with a toner image fixed thereon is nipped between the first belt 501 and the second belt 502 and conveyed in the conveyance direction (the arrow D in FIG. 3) due to the rotations of these belts. At this time, the recording material S passes through the cooling nip portion T4 formed by the first belt 501 and the second belt 502 in contact with each other. According to the present exemplary embodiment, the first belt 501 is cooled by the heat sink 503.

To efficiently cool the recording material S, the heat sink 503 is disposed to be in contact with the inner surface of the first belt 501 at a position where the cooling nip portion T4 is formed. When the recording material S passes through the cooling nip portion T4, the recording material S is cooled by the heat sink 503 via the first belt 501. For example, when the temperature of the recording material S is around 90° C. before passing through the recording material cooling apparatus 50, the recording material S is cooled so that its temperature decreases to around 60° C. after passing through the recording material cooling apparatus 50. As the recording material S is cooled down, toner on the recording material S is also cooled down and fixed.

The heat sink 503 is made of a metal such as aluminum. The heat sink 503 includes a heat reception unit 503*a* for drawing heat from the first belt 501 by contacting the first belt 501, a heat radiation unit 503*b* for radiating heat, and a fin base 503*c* for transferring heat from the heat reception unit 503*a* to the heat radiation unit 503*b*.

The heat radiation unit 503*b* is formed of a number of radiating fins to promote efficient heat radiation with a large area of contact with the air. For example, a radiating fin is set to be 1 mm in thickness, 100 mm in height, and 5 mm in pitch, and the fin base 503*c* is set to be 10 mm in thickness.

A cooling fan 513 for sending air toward the heat sink 503, more specifically, the heat radiation unit 503*b*, is provided to forcibly cool the heat sink 503 itself. The air volume of the cooling fan 513 is set, for example, to 2 $m^3$/min. The cooling method for the heat sink 503 is not limited to the cooling fan 513. The heat sink 503 may be cooled, for example, by a cooling medium.

In such the recording material cooling apparatus 500, the first belt 501 shifts to widthwise end sides of the first belt suspension rollers 501*a* to 501*e* by the dispersion of the dimensional tolerance of the first belt suspension rollers 501*a* to 501*e* supporting the first belt 501 and the dispersion of the dimensional tolerance of a pair of frames supporting both ends of the first belt suspension rollers 501*a* to 501*e*. Likewise, the second belt 502 shifts toward widthwise end sides of the first belt suspension rollers 501*a* to 501*e* by the dispersion of the dimensional tolerance of the second belt suspension rollers 502*a* to 502*e* supporting the second belt 502 and the dispersion of the dimensional tolerance of a pair of frames supporting both ends of the second belt suspension rollers 502*a* to 502*e*. As a result, an end of the first belt 501 or the second belt 502 may possibly be in friction with either one of a pair of frames disposed at both widthwise ends of the recording material cooling apparatus 50. Therefore, by swinging one of the plurality of rollers supporting the first belt 501 and the second belt 502, as a steering roller, relative to other rollers, the present exemplary embodiment performs steering control to reciprocate the first belt 501 and the second belt 502 in the widthwise directions. This prevents the widthwise ends of the first belt 501 and the second belt 502 from being in friction with the above-described frame.

To perform steering control in this way, there are provided sensor units 390 and 391 for detecting widthwise end positions of the first belt 501 and the second belt 502. The widthwise direction of the first belt 501 is the rotational axis direction of the first belt suspension rollers 501*a* to 501*e*, and the widthwise direction of the second belt 502 is the rotational axis direction of the second belt suspension rollers 502*a* to 502*e*. Based on the detection signals of the sensor units 390 and 391, the widthwise end positions of the rotating first belt 501 and the rotating second belt 502 are detected. The sensor unit 390 is capable of detecting the widthwise end positions of the first belt 501 at a plurality of positions to detect how much the widthwise center of the first belt 501 deviates from the widthwise centers of the first belt suspension rollers 501*a* to 501*e*. Likewise, the sensor unit 391 is capable of detecting widthwise end positions of the second belt 502 at a plurality of positions to detect how much the widthwise center of the second belt 502 deviates from the widthwise centers of the second belt suspension rollers 502*a* to 502*e*. Then, based on the end positions detected by the sensor units 390 and 391, the above-described steering mechanisms 400 are operated so that the first belt 501 and the second belt 502 are positioned at the widthwise center, respectively. More specifically, the angles of the steering rollers 501*a* and 502*a* are adjusted based on the detection signals of the sensor units 390 and 391, respectively. The sensor units 390 and 391 are examples of belt position detection units. The "widthwise direction" according to the present exemplary embodiment refers to the direction perpendicular to the thickness direction of the first belt 501 and the conveyance direction of the sheet nipped by the cooling nip portion T4, and is the rotational axis direction of the steering rollers 501*a* and 502*a*. The "widthwise direction" refers to the rotational axis direction of the first belt suspension rollers 501*b* to 501*e*, and also to the rotational axis direction of the second belt suspension rollers 502*b* to 502*e*.

Figure 8:
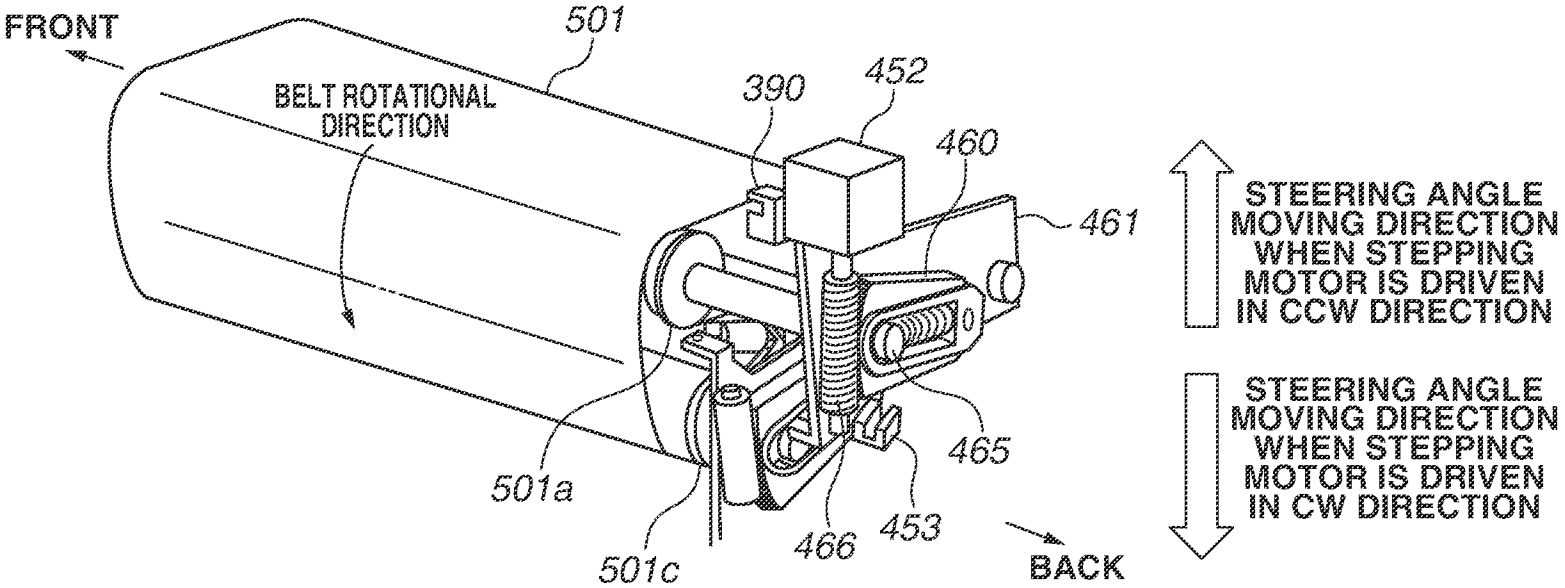
FIG. 8 illustrates a belt steering mechanism of the cooling apparatus according to the exemplary embodiment.

The steering mechanisms 400 for the first unit 501 U and the second unit 502 U have almost similar configurations. Therefore, the steering mechanism 400 for the first unit 501 U will be described as a representative with reference to FIG. 8.

A steering control stepping motor 452, a worm gear 466, and a sector gear 460 are supported by the back side plate 461 on the back side of the cooling apparatus 500. The shaft 465 is fixed to the roller holder 800 supporting the shaft of the first belt suspension roller 501*a*. The sensor unit 390 is a belt end detection sensor.

When the steering control stepping motor 452 is driven in the clockwise (CW) direction, the worm gear 466 rotates, and then the sector gear 460 is downwardly oriented around the shaft. Accordingly, the shaft 465 downwardly moves and hence the roller holder 800 with the shaft 465 fixed thereto swings around the swing axis 802. As a result, the steering roller 501*a* supported by the roller holder 800 is inclined toward the back side in the rotational axis direction of the steering roller 501*a*. Then, the first belt 501 moves toward the back side with the rotation of the first belt 501. According to the present exemplary embodiment, the back side refers to the side closer to an opening/closing mechanism 510 in the rotational axis direction of the steering roller 501*a*, and the back side refers to the rear surface side of the image forming apparatus 100.

On the other hand, when the steering control stepping motor 452 is driven in the counterclockwise (CCW) direction, the worm gear 466 rotates, and then the sector gear 460 is upwardly oriented around the shaft. Accordingly, the shaft 465 upwardly moves and hence the roller holder 800 with the shaft 465 fixed thereto swings around the swing axis 802. As a result, the steering roller 501*a* is slightly inclined toward the front side in the rotational axis direction of the steering roller 501*a*. Then, the first belt 501 moves toward the front side (right direction in FIG. 7B) with the rotation of the first belt 501.

Figure 9:
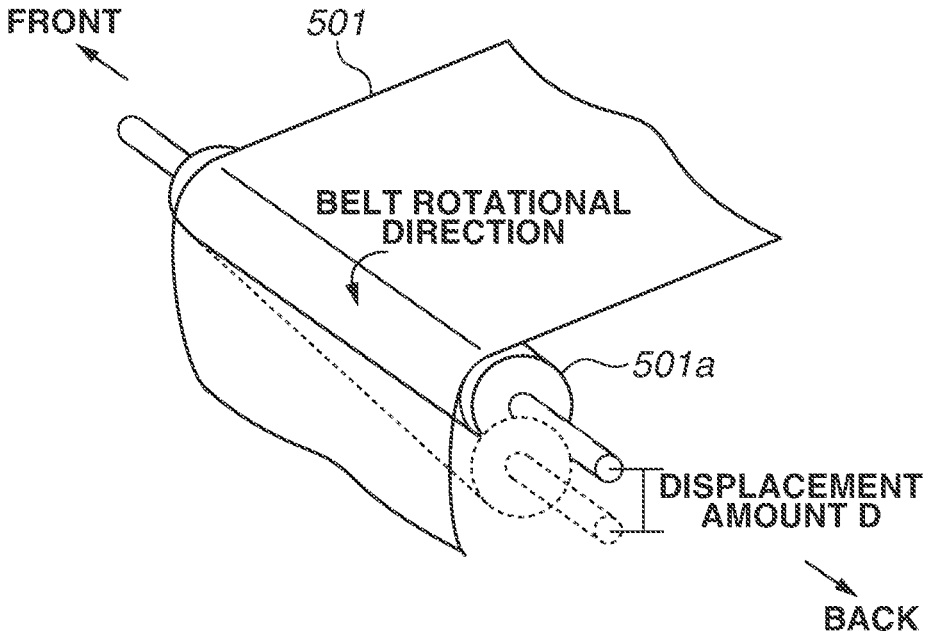
FIG. 9 illustrates the belt steering mechanism of the cooling apparatus according to the exemplary embodiment.

FIG. 9 illustrates a case where the steering roller 501*a* is inclined to move back the position of the first belt 501 of the first unit 501 U from a back side position to a front side position. The drive for inclining the steering roller 501*a* is positioned on the back side, as described above, an end of the steering roller 501*a* is raised by the steering control stepping motor 452. Hereinafter, the displacement amount of the end of the steering roller 501*a* is referred to as a displacement amount D of the end of the steering roller 501*a*. The positive (+) direction of the displacement amount D is the upward direction in which the first belt 501 is moved toward the front side in the rotational axis direction of the steering roller 501*a*. The negative (−) direction of the displacement amount D is the downward direction in which the first belt 501 is moved toward the back side in the rotational axis direction of the steering roller 501*a*.

When the displacement amount D of the end changes, the widthwise position of the first belt 501 tends to move following the change. Ideally, the first belt 501 is positioned at a position where the widthwise center of the first belt 501 coincides with the widthwise center of the steering roller 501*a*. At this ideal position, the angle of the steering roller 501*a* is approximately horizontal, and the above-described displacement amount D is the reference displacement amount ±0.

Ideally, when the displacement amount D is the reference displacement amount ±0, the belt does not widthwisely move from that position. Actually, however, the first belt 501 shifts to either end of the steering roller 501*a* because of the above-described dimensional tolerance and other various factors. As a result, the first belt 501 moves in the widthwise direction of the first belt suspension roller. Therefore, the position of the reference displacement amount ±0 is set to be the reference position of the steering roller 501*a*, at which the steering HP sensor 453 turns OFF from ON by the sector gear 460. The CPU 601 determines that the steering HP sensor 453 is ON when it is shielded from light and OFF when it is not shielded from light. The steering HP sensor 453 is an example of a steering position detection unit for detecting the positions (displacements) of the steering rollers 501*a* and 501*b*, i.e., the angles relative to other rollers.

The displacement amount D of the steering roller 501*a* is determined by the position of the first belt 501 detected by the sensor unit 390. More specifically, when the first belt 501 is positioned more on the front side than the widthwise center, a negative displacement amount of the steering roller 501*a* is set, and the first belt 501 is moved back to the widthwise center. When the first belt 501 is positioned more on the back side than the widthwise center, a positive displacement amount of the steering roller 501*a* is set, and the first belt 501 is moved back to the widthwise center. According to the present exemplary embodiment, the sensor unit 390 enables detecting a total of seven belt positions, i.e., the center position, three positions on the back side, and three positions on the front side. When the first belt 501 is positioned at the center, the steering mechanism 400 sets the steering roller 501*a* to the reference position. When the first belt 501 is positioned at either one of the six positions except for the center, the steering mechanism 400 inclines the steering roller 501*a* to set the angle of the steering roller 501*a* corresponding to each position. For example, when the first belt 501 is positioned more on the back side than the center, the steering mechanism 400 gradually changes the angle of the steering roller 501*a* (+0.75°, +1.5°, and +1.8°) corresponding to the position of the first belt 501. When the first belt 501 is positioned more on the front side than the center, the steering mechanism 400 gradually changes the angle of the steering roller 501*a* (−0.75°, −1.5°, and −1.8°) corresponding to the position of the first belt 501. In this way, the steering mechanism 400 can swing the steering roller 501*a* within a range from +1.8° to −1.8°. Although the present exemplary embodiment defines the swing angles of the steering roller 501*a* as described above, it is not limited thereto.

When the steering rollers 501*a* and 501*b* are inclined in the recording material cooling apparatus 50 having the steering mechanism 400, the first belt 501 or the second belt 502 is hard to pull out in replacing the first belt 501 or the second belt 502, respectively. This means that inclined steering rollers degrade the workability in belt replacement. In particular, when the first steering roller 501*a* or the second steering roller 501*b* is stopping at such an inclination angle that the first belt 501 or the second belt 502 moves toward the back side of the recording material cooling apparatus 50, the workability in belt replacement degrades because of the increased pressure in the pulling direction for the first belt 501 or the second belt 502.

When the heat sink 503 is provided in the inner circumferential surface of a conveyance belt, like the first belt 501 in the recording material cooling apparatus 50, the heat sink 503 occupies a large area in the conveyance belt to improve the cooling efficiency. Accordingly, even when the steering mechanism 400 is configured to move the steering roller 501*a* toward the inner circumferential side of the first belt 501 against the biasing force of the spring 507*a* that presses the steering roller 501*a* toward the inner circumferential surface of the first belt 501 in replacing the first belt 501, a sufficient moving amount of the steering roller 501*a* cannot be obtained because of the presence of the heat sink 503.

Accordingly, when changing the first belt 501 in a state where the steering roller 501*a* is inclined, the first belt 501 is hard to pull out against the suspension rollers 501*a* to 501*d*, making it hard to attach a new belt.

According to the present exemplary embodiment, the steering roller 501*a* is moved back to the reference position so that the axis line of the steering roller 501*a* becomes approximately parallel to the axis lines of other suspension rollers 501*b* to 501*d* before the image forming apparatus 100 requiring the replacement of the first belt 501 enters the power-off state or the power-saving state. According to the present exemplary embodiment, "approximately parallel" also includes, for example, a position deviated from the reference displacement amount ±0 within a range of ±0.5° when the state of the reference displacement amount ±0 is assumed to be the parallel state. A sequence for moving the steering roller 501*a* to the reference position will be described in detail below.

The first belt 501 of the first unit 501 U has been described above with reference to FIGS. 8 and 9, and the second belt 502 of the second unit 502 U has a similar basic configuration.

A method for removing the recording material S from the recording material cooling apparatus 50 when the recording material S is clogged in the recording material cooling apparatus 50, and the swing configuration provided for the drive trains 504*a* to 504*d* will be described with reference to FIGS. 4 and 5.

Figure 4:
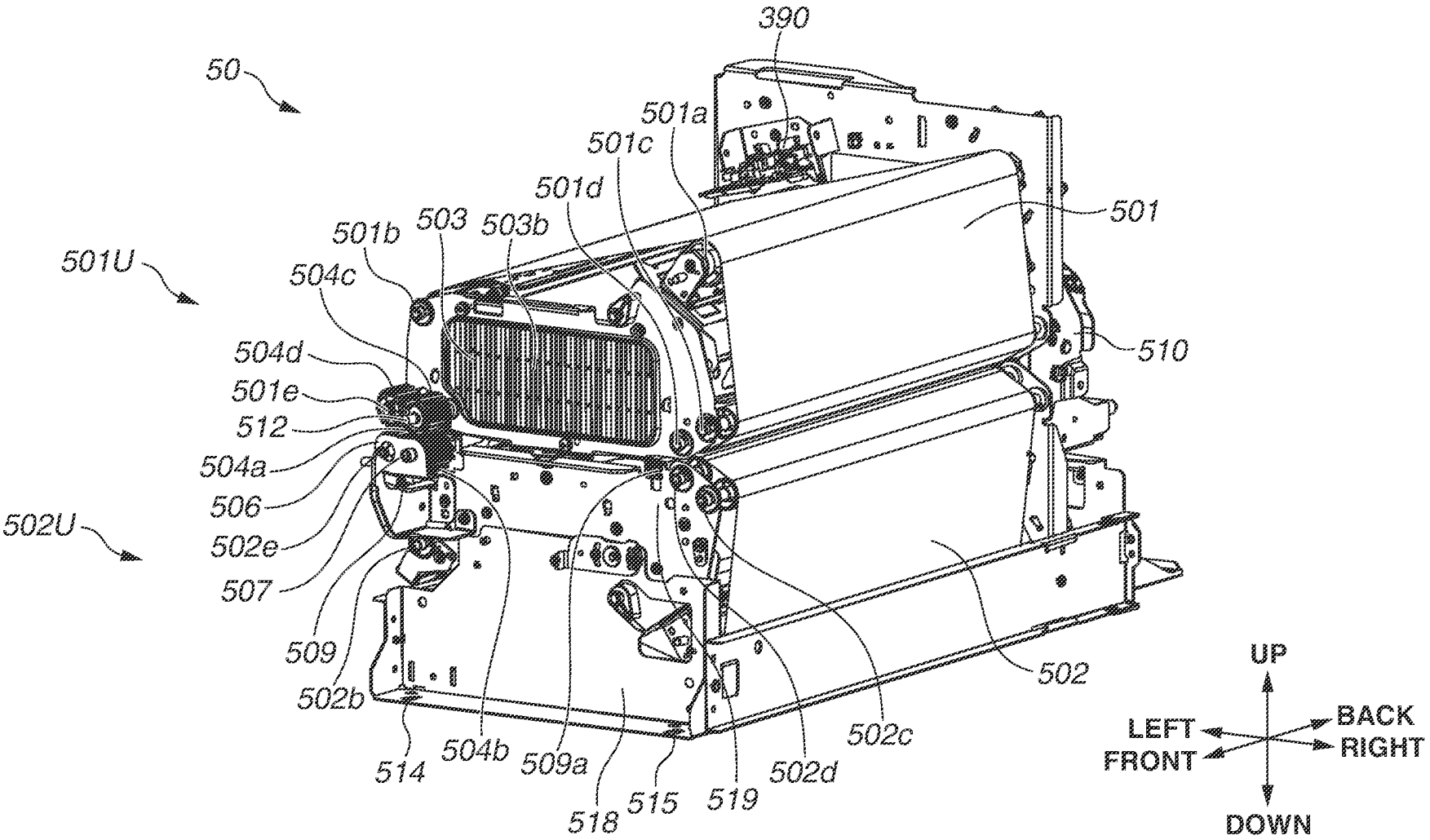
FIG. 4 illustrates the cooling apparatus according to the exemplary embodiment.

FIG. 4 illustrates a state where the recording material S is conveyed in the recording material cooling apparatus 50. The cooling nip portion T4 is formed by the first unit 501 U for suspending the first belt 501 by using the first belt suspension rollers 501*a* to 501*e*, and the second unit 502 U for suspending the second belt 502 by using the second belt suspension rollers 502*a* to 502*e* (see FIG. 3).

The second unit 502 U is provided with the drive train 504*a* rotatably supported by a shaft end portion of the second belt suspension roller 502*e* via a bearing (not illustrated), and the rotation support member 506. The rotation support member 506 is provided with the second idler shaft 507 fixed thereto. The second idler shaft 507 is provided with the drive train 504*b* rotatably supported via a bearing (not illustrated). The drive trains 504*a* and 504*b* are disposed to transmit a driving force.

The rotation support member 506 is connected with the spring member 509 connected with a fixing member 508, and applies tension to the rotation support member 506 rotatably supported by a shaft end portion of the second belt suspension roller 502*e* via a bearing (not illustrated).

The first unit 501 U is provided with the first idler shaft 512 fixed thereto, and is provided with the drive train 504*c* rotatably supported by the first idler shaft 512 via a bearing (not illustrated). A shaft end portion of the first belt suspension roller 501*e* is provided with the drive train 504*d* rotatably supported via the one-way clutch 505 illustrated in FIG. 3. The drive trains 504*c* and 504*d* are disposed to transmit a driving force.

When the first unit 501 U illustrated in FIG. 4 contacts the second unit 502 U, the drive train 504*b* of the second unit 502 U can transmit a driving force with the drive train 504*c* of the first unit 501 U.

Figure 5:
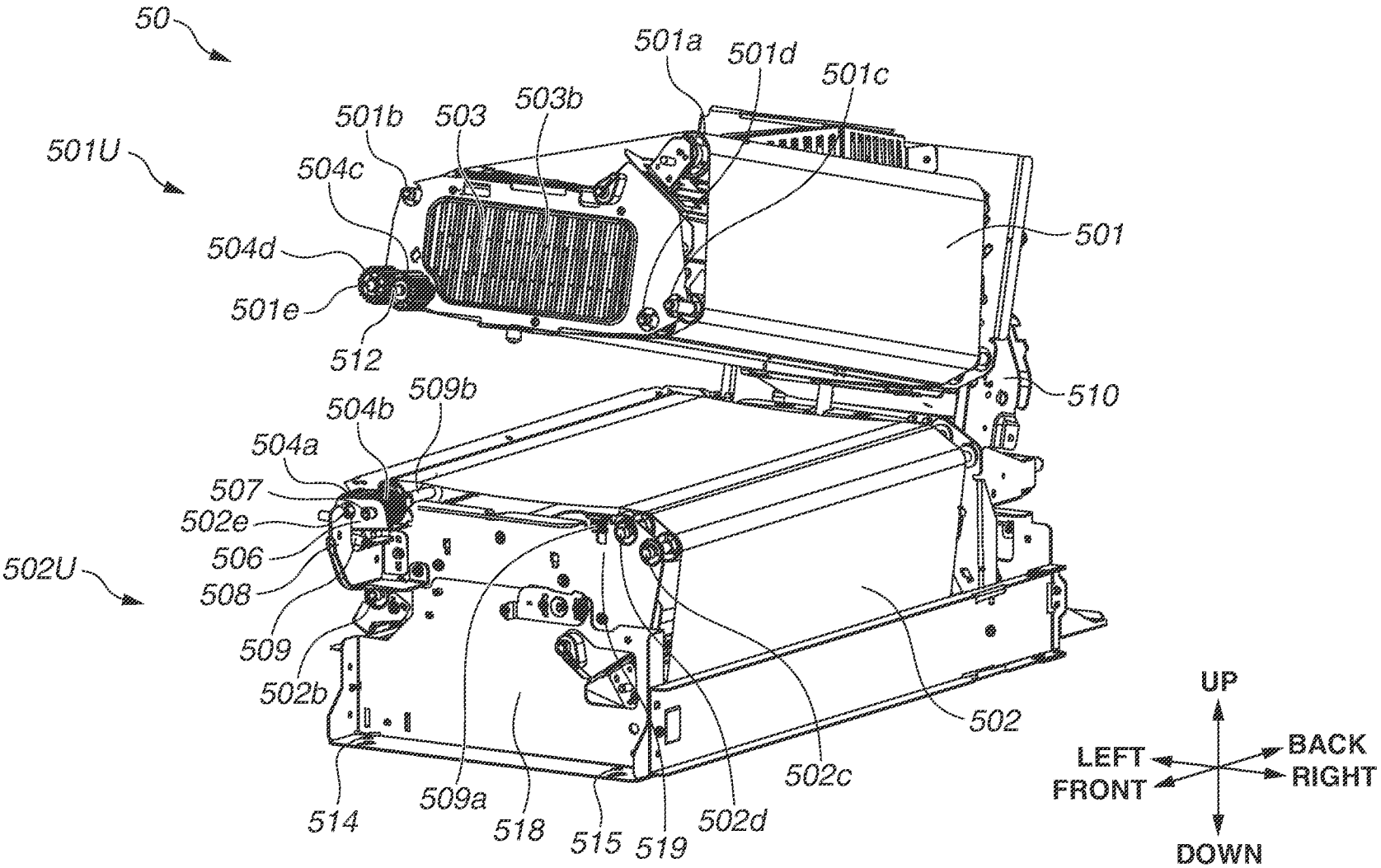
FIG. 5 illustrates the cooling apparatus according to the exemplary embodiment.

The first unit 501 U is supported to be openable and closable by a rotation shaft (not illustrated) provided in the opening/closing mechanism 510, to enable maintaining a state where the cooling nip portion T4 in FIG. 4 is formed and a state where the cooling nip portion T4 in FIG. 5 is not formed. FIG. 5 illustrates a state where the recording material S clogged in the recording material cooling apparatus 50 is to be removed. The first unit 501 U and the second unit 502 U are separated without forming the cooling nip portion T4 illustrated in FIG. 3.

When the first unit 501 U illustrated in FIG. 5 is separated from the second unit 502 U, the drive train 504*b* of the second unit 502 U cannot transmit a driving force with the drive train 504*c* of the first unit 501 U. The rotation support member 506 rotatably supported by a shaft end portion of the second belt suspension roller 502*e* via a bearing (not illustrated) receives tension from the spring member 509 connected with the fixing member 508, and rotates counterclockwise around the rotation center of the second belt suspension roller 502*e*.

When the rotation support member 506 rotates counterclockwise, a rotation regulation portion (not illustrated) of the rotation support member 506 interferes with a second unit front upper plate 519, and the rotation support member 506 is regulated at a constant angle. This constant angle is set so that, when a state where the cooling nip portion T4 is not formed (see FIG. 5) is changed to a state where the cooling nip portion T4 is formed (see FIG. 4), the drive train 504*c* of the first unit 501 U and the drive train 504*b* of the second unit 502 U are engaged with each other to enable transmitting a driving force again.

In addition, when the belt drive motor 511 rotates the second belt in the direction of the arrow C in FIG. 3, the drive train 504*b* rotates around the shaft end portion of the second belt suspension roller 502*e* by the force generated by the drive trains 504*b* and 504*c*. The drive trains 504*b* arranged to be constantly biased relative to the drive train 504*c* attached to the first unit 501 U.

How the recording material cooling apparatus 50 is fixed will be described with reference to FIGS. 1, 5, 6, 7A, and 7B. As illustrated in FIG. 1, the recording material cooling apparatus 50 is disposed in an apparatus body 100A.

Figure 6:
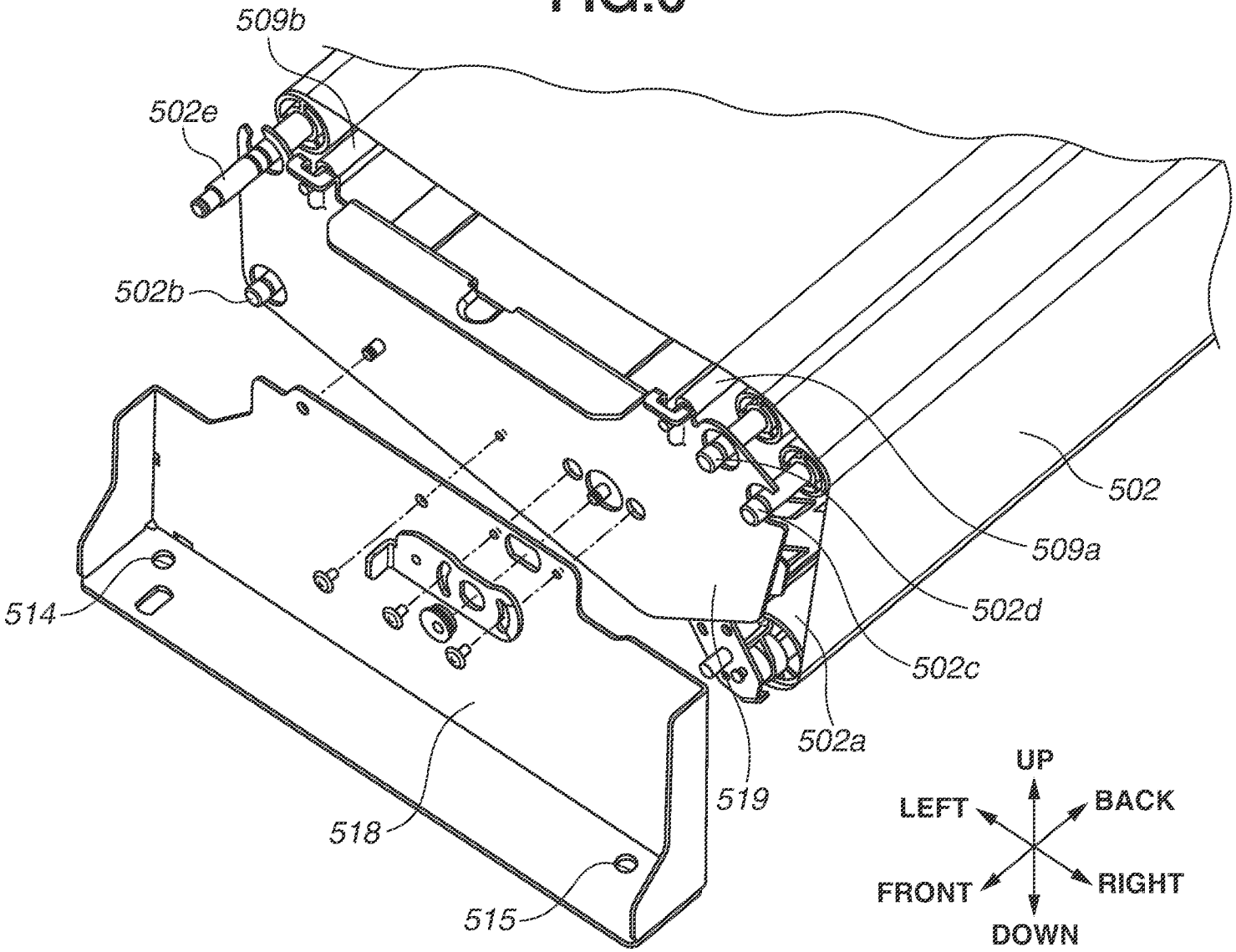
FIG. 6 illustrates the cooling apparatus according to the exemplary embodiment.

The recording material cooling apparatus 50 is provided with positioning support members 514 and 515 illustrated in FIGS. 5 and 6, and positioning support members 516 and 517 illustrated in FIGS. 7A and 7B. The recording material cooling apparatus 50 is supported by the apparatus body 100A with these positioning support members 514, 515, 516, and 517. According to the present exemplary embodiment, as illustrated in FIGS. 5 and 6, a second unit front lower plate 518 is provided with hole portions as the positioning support members 514 and 515. The recording material cooling apparatus 50 is fixed so that the hole portions are in contact with a convex portion of the apparatus body 100A. More specifically, the positioning support members 514 and 515 are used to determine positions relative to the support frame of the image forming apparatus 100 at positions on the front side of the recording material cooling apparatus 50.

As illustrated in FIGS. 7A and 7B, there are provided axial portions as the positioning support members 516 and 517. The recording material cooling apparatus 50 is fixed so that the positioning support members 516 and 517 are engaged with holes on the vertical wall of the apparatus body 100A. Thus, the positioning support members 516 and 517 are used to determine the position the recording material cooling apparatus 50 relative to the frame of the image forming apparatus 100 at the positions on the back side of the recording material cooling apparatus 50.

<Sequence for Moving Steering Roller to Reference Position>

Figure 10:
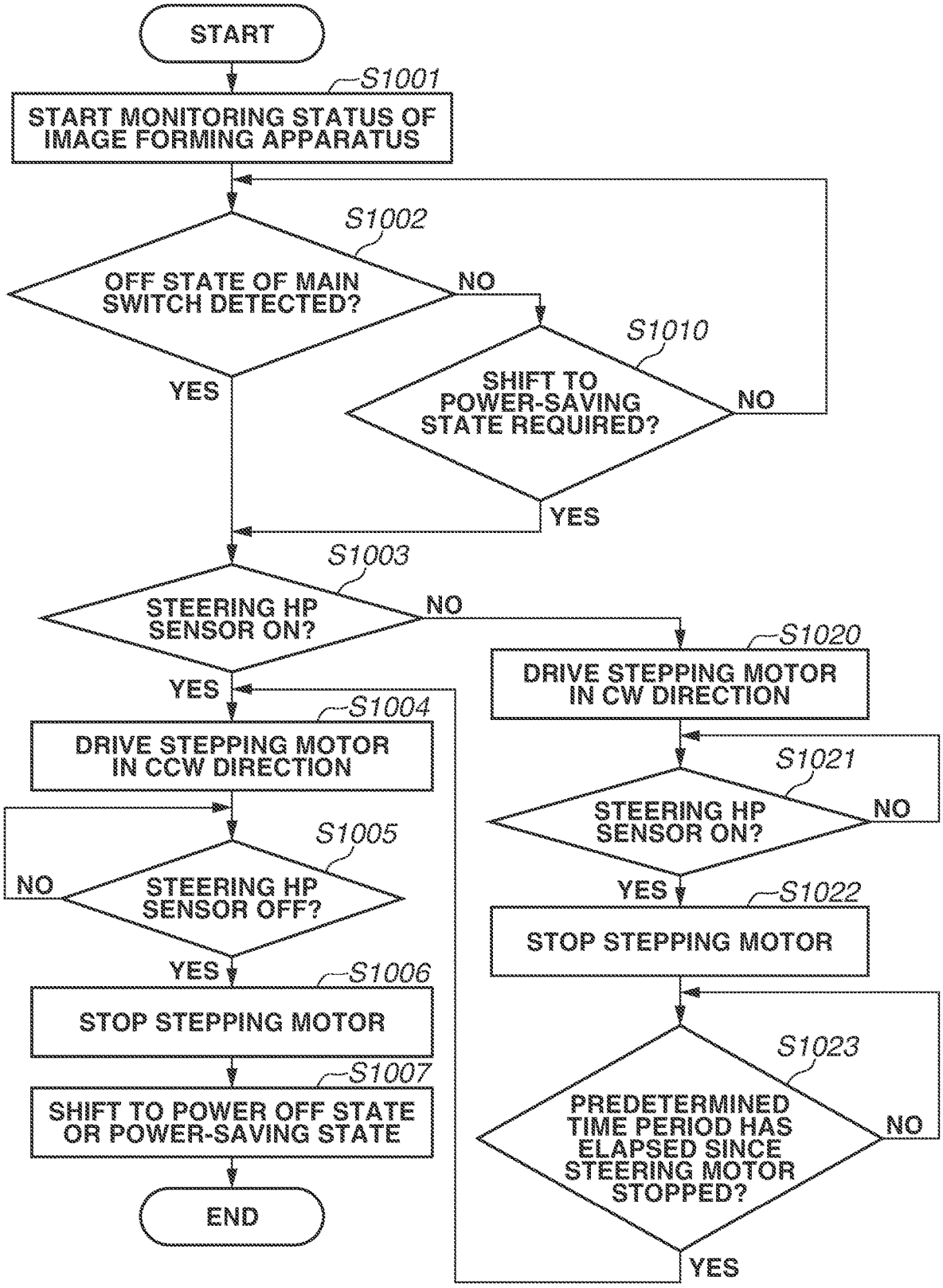
FIG. 10 is a flowchart illustrating a steering roller control when power of the cooling apparatus according to the exemplary embodiment is OFF.

FIG. 10 illustrates a sequence for moving the steering roller 501*a* according to the present exemplary embodiment to the reference position (the displacement amount D ±0 in FIG. 9). The first unit 501 U and the second unit 502 U have approximately the same configurations. The steering roller 501*a* of the first unit 501 U will be described as a representative.

In step S1001, the CPU 601 starts monitoring the status of the image forming apparatus 100. More specifically, the CPU 601 monitors whether the main switch 410 is OFF (a trigger for shifting the image forming apparatus 100 to the power-off state), whether the image reading unit 901, the image generation unit 902, and other units of the image forming apparatus 100 do not operate for a predetermined time period, or whether a request for entering the power-saving state is input from the operation panel 40 (a trigger for shifting the image forming apparatus 100 to the power-saving state).

In step S1002, the CPU 601 monitors whether the OFF state of the main switch 410 is detected. When the CPU 601 detects that the main switch 410 is OFF (YES in step S1002), the processing proceeds to step S1003. On the other hand, when the CPU 601 does not detect the OFF state of the main switch 410 (NO in step S1002), the processing proceeds to step S1010. In step S1010, the CPU 601 determines whether the transition to the power-saving state is required. As described above, the CPU 601 determines that the transition to the power-saving state is required when the image reading unit 901, the image generation unit 902, and other units of the image forming apparatus 100 do not operate for a predetermined time period or when a request for entering the power-saving state is input from the operation panel 40.

When the CPU 601 determines that the transition of the image forming apparatus 100 to the power-saving state is required (YES in step S1010), the processing proceeds to step S1003. On the other hand, when the CPU 601 determines that the transition to the power-saving state is not required (NO in step S1010), the processing returns to step S1002. In step S1002, the CPU 601 continues monitoring the status of the image forming apparatus 100. In step S1003, the CPU 601 determines whether the steering HP sensor 453 is ON. The CPU 601 detects that the steering HP sensor 453 is ON when it is shielded from light by the sector gear 460 and OFF when it is not shielded from light.

When the CPU 601 determines that the steering HP sensor 453 is ON (YES in step S1003), the processing proceeds to step S1004. In step S1004, the CPU 601 starts driving the steering control stepping motor 452 in the CCW direction.

Then, the CPU 601 continues driving until the steering HP sensor 453 turns OFF. In step S1005, the CPU 601 determines whether the steering HP sensor 453 is OFF. When the CPU 601 detects that the steering HP sensor 453 is OFF (YES in step S1005), the processing proceeds to step S1006. In step S1006, the CPU 601 stops the steering control stepping motor 452. Then, the CPU 601 sets the stop position as the reference position. Although, in the present exemplary embodiment, the CPU 601 stops the steering control stepping motor 452 based on the OFF state of the steering HP sensor 453, the CPU 601 may stop the motor when a predetermined time period has elapsed since the OFF state of the steering HP sensor 453 has been detected. More specifically, the steering roller 501*a* may move over a predetermined distance from the position where the OFF state of the steering HP sensor 453 has been detected.

On the other hand, when the CPU 601 detects that the steering HP sensor 453 is OFF (NO in step S1003), the processing proceeds to step S1020. In step S1020, the CPU 601 starts driving the steering control stepping motor 452 in the CW direction. In step S1021, the CPU 601 continues driving the motor until the steering HP sensor 453 turns ON.

In step S1021, the CPU 601 determines whether the steering HP sensor 453 is ON. When the CPU 601 detects that the steering HP sensor 453 is ON (YES in step S1021), the processing proceeds to step S1022. In step S1022, the CPU 601 stops the steering control stepping motor 452. In step S1023, the CPU 601 determines whether a predetermined time period (the time period until the vibration when the motor stops becomes stable) has elapsed since the CPU 601 has detected the stop of the steering control stepping motor 452. When the CPU 601 determines that the predetermined time period has not elapsed (NO in step S1023), the CPU 601 waits until the predetermined time period has elapsed.

On the other hand, when the CPU 601 determines that the predetermined time period has elapsed (YES in step S1023), the processing returns to step S1004. In step S1004, the CPU drives the steering control stepping motor 452 in the CCW direction. In step S1005, the CPU 601 continues driving the motor until the steering HP sensor 453 turns OFF. When the CPU 601 detects that the steering HP sensor 453 is OFF (YES in step S1005), the processing proceeds to step S1006. In step S1006, the CPU 601 stops the steering control stepping motor 452. Then, the CPU 601 sets the stop position as the reference position. In step S1007, the CPU 601 shifts the image forming apparatus 100 to the power-off state or the power-saving state.

When the image forming apparatus 100 enters the power-off state (the main switch 410 turned OFF) or the power-saving state, the present exemplary embodiment moves the steering roller 501*a* to the reference position (the position where the axis line of the steering roller 501*a* is approximately parallel to the axis lines of other first belt suspension rollers 501*b* to 501*d*), thus facilitating belt replacement. Although the present exemplary embodiment is configured to move the steering roller 501*a* to the reference position when the image forming apparatus 100 enters the power-off state or the power-saving state, it is not limited thereto. For example, the present exemplary embodiment may be configured to move the steering roller 501*a* to the reference position only when the image forming apparatus 100 enters the power-off state. The present exemplary embodiment may also be configured to move the steering roller 501*a* to the reference position only when the image forming apparatus 100 enters the power-saving state. The present exemplary embodiment may also be configured to, when the image forming apparatus 100 enters the power-saving state and then the power-off state, move the steering roller 501*a* to the reference position at the timing before the image forming apparatus 100 enters the power-saving state and at the timing before the image forming apparatus 100 enters the power-off state. The present exemplary embodiment may also be configured to move the steering roller 501*a* to the reference position when the image forming apparatus 100 enters the power-off state or the power-saving state and when the image forming apparatus 100 stops operating in a state where the steering roller 501*a* is inclined relative to the reference position. More specifically, when the steering roller 501*a* stops operating at the reference position when the image forming apparatus 100 enters the power-off state or the power-saving state, the CPU 601 does not need to perform the above-described control.

<Sequence When Main Switch Is ON>

Figure 11:
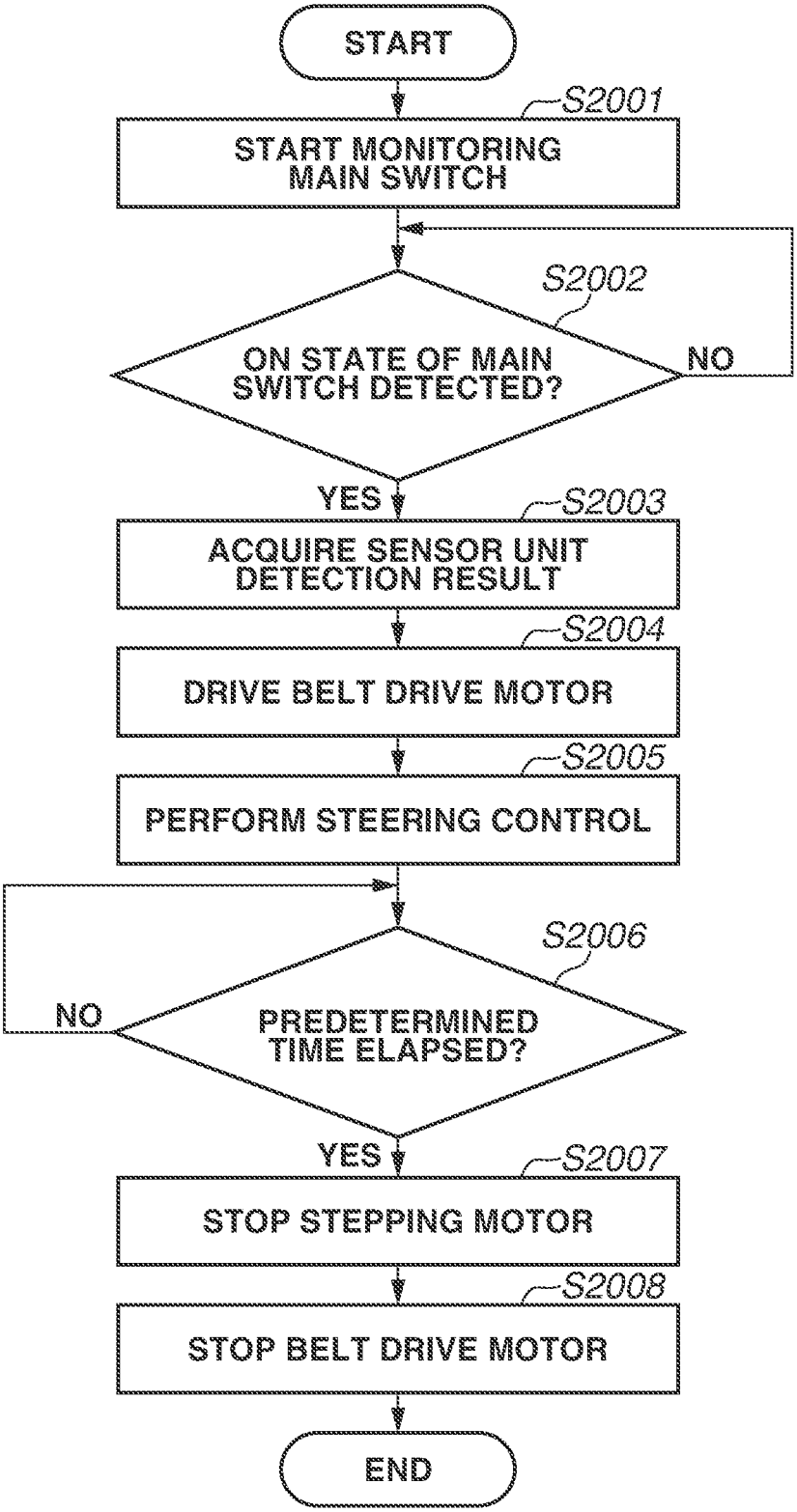

FIG. 11 illustrates a sequence when the main switch 410 according to the present exemplary embodiment is turned ON. Since the first unit 501 U and the second unit 502 U have approximately the same control configurations, the first unit 501 U will be described as a representative.

In step S2001, the CPU 601 monitors the status of the main switch 410. When the main switch 410 is not ON (NO in step S2002), the CPU 601 waits until the main switch 410 is turned ON. On the other hand, when the main switch 410 is ON (YES in step S2002), the processing proceeds to step S2003. In step S2003, the CPU 601 acquires the detection result by the sensor unit 390.

In step S2004, the CPU 601 drives the belt drive motor 511 to rotate the first belt 501. In step S2005, the CPU 601 drives the stepping motor 452 based on the detection result by the sensor unit 390 acquired in step S2003 to perform steering control. Detailed steering control is similar to the above-described steering control, and redundant descriptions thereof will be omitted.

In step S2006, the CPU 601 determines whether a predetermined time period has elapsed since the steering control has been started. When the predetermined time period has elapsed (YES in step S2006), the processing proceeds to step S2007. In step S2007, the CPU 601 stops the stepping motor 452. In step S2008, the CPU 601 stops the belt drive motor 511.

In this way, the CPU 601 also performs the steering control for the steering roller 501*a* when the main switch 410 is turned ON, and then the image forming apparatus 100 enters the standby state (when the image forming apparatus 100 is activated). This is because the widthwise position of the first belt 501 may possibly change by a replacement work during the power-off state of the image forming apparatus 100. This is because, even if the first belt 501 is not replaced, performing control to move the steering roller 501*a* back to the reference position before the image forming apparatus 100 enters the power-off state may possibly deviate the angle of the steering roller 501*a* relative to the position of the first belt 501.

Thus, performing the steering control during activation of the image forming apparatus 100 enables preventing the first belt 501 or the second belt 502 from shifting all the way to an end of the steering roller 501*a* or 502*a*, respectively. Performing the steering control during activation of the image forming apparatus 100 also enables setting the angle of the steering roller 501*a* or 502*a* suitable for the position of the first belt 501 or the second belt 502, respectively. The above-described predetermined time period in step S2006 needs to be set to a time period during which the angle of the steering roller 501*a* or 502*a* suitable for the position of the first belt 501 or the second belt 502 can be resumed even with the maximum amount of deviation of the position of the first belt 501 or the second belt 502 from the steering roller 501*a* or 502*a*, respectively.

For example, when the main switch 410 of the image forming apparatus 100 is turned OFF in a state where the first belt 501 is positioned more on the back side than the center of the image forming apparatus 100, the steering roller 501*a* returns to the reference position by the above-described control. However, depending on the timing when the first belt 501 stops rotating, the position of the first belt 501 in the rotational axis direction of the steering roller 501*a* deviates from the angle of the steering roller 501*a*. However, even if the position of the first belt 501 is more on the back side than the center, performing the steering control when the main switch 410 is turned ON as described above swings the steering roller 501*a* to the position where the first belt 501 is moved back to the center based on the detection result by the sensor unit 390. This enables preventing the position of the first belt 501 from deviating from the angle of the steering roller 501*a*, thus preventing the first belt 501 from deviating all the way to an end.

When the steering control is performed in response to the main switch 410 being turned ON, the first belt 501 and the second belt 502 rotate since the first belt suspension roller 501*e* and the second belt suspension roller 502*e* are rotating. In this case, the CPU 601 may determine whether a sheet is nipped by the cooling nip portion T4 by sensors (not illustrated) disposed on the upstream and downstream sides of the cooling nip portion T4 in the sheet conveyance direction. In this case, if a sheet is nipped by the cooling nip portion T4, the CPU 601 may display a message for prompting the user to remove the sheet. With this message, even if power is turned ON in a state where a sheet remains nipped by the cooling nip portion T4 because of a conveyance failure, removing the sheet enables normally starting the operation of the recording material cooling apparatus 50. The above-described predetermined time period in step S2006 may be set to a time period during which the CPU 601 can determine whether a sheet is nipped by the cooling nip portion T4 by sensors (not illustrated).

Although the above-described exemplary embodiment performs the steering control when the main switch 410 is turned ON, it is not limited thereto. The present exemplary embodiment may also be configured to perform the steering control when the image forming apparatus 100 changes from the power-saving state to the standby state. In this case, even if the CPU 601 performs control to move the steering roller 501*a* back to the reference position before the image forming apparatus 100 enters the power-saving state, the positional difference between the steering roller 501*a* and the first belt 501 can be dissolved.

Although the above-described exemplary embodiment is configured to move the steering roller 501*a* to the position where the axis line of the steering roller 501*a* is approximately parallel to the axis lines of other first belt suspension rollers 501*b* to 501*d* before the image forming apparatus 100 enters the power-off state or the power-saving state, the present exemplary embodiment may also be configured to move the steering roller 501*a* to the reference position upon reception of an operator's instruction for replacing the first belt 501 (or the second belt 502) from the operation panel 40. More specifically, the present exemplary embodiment may also be configured to move the steering roller 501*a* to the position where the axis line of the steering roller 501*a* is approximately parallel to the axis lines of other first belt suspension rollers 501*b* to 501*d* by an input from the operation panel 40. This also enables improving the workability in replacing the first belt 501 (or the second belt 502).

Although the present exemplary embodiment stops the steering control stepping motor 452 based on the OFF state of the steering HP sensor 453, the motor may be stopped when a predetermined time period has elapsed since the OFF state of the steering HP sensor 453 has been detected. Performing control in this way enables reliably moving the steering roller 501*a* to the reference position regardless of the displacement amount of the steering roller 501*a* when control has been started.

Moving the steering roller 501*a* to the reference position before the image forming apparatus 100 enters the power-off state or power-saving state as is in the present exemplary embodiment enables preventing the operation from stopping in a state where the steering roller 501*a* is inclined during replacement of the first belt 501. This reduces the load on the inclined steering roller 501*a* applied when the first belt 501 is pulled out, making it possible to provide an image forming apparatus that facilitates belt replacement.

Figure 12:
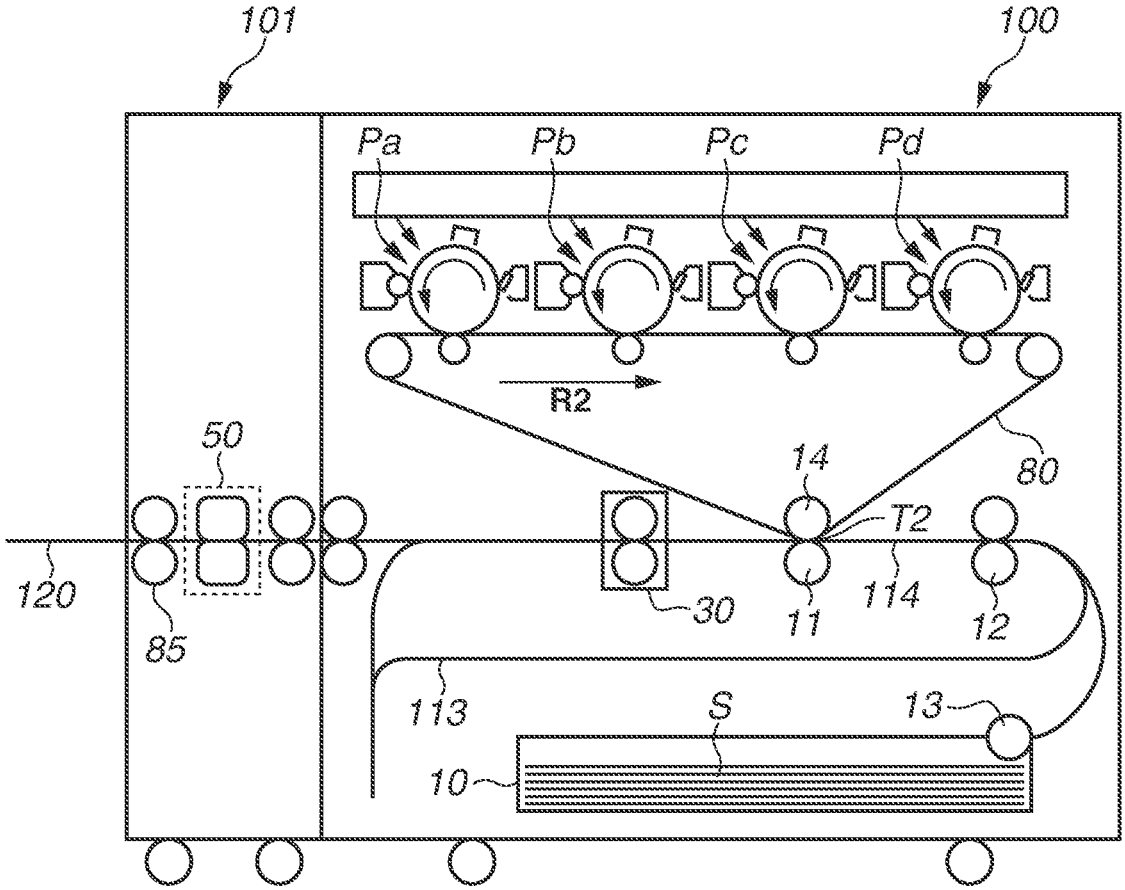
FIG. 12 illustrates a configuration in which a recording material cooling apparatus is disposed outside the image forming apparatus.
Figure 13:
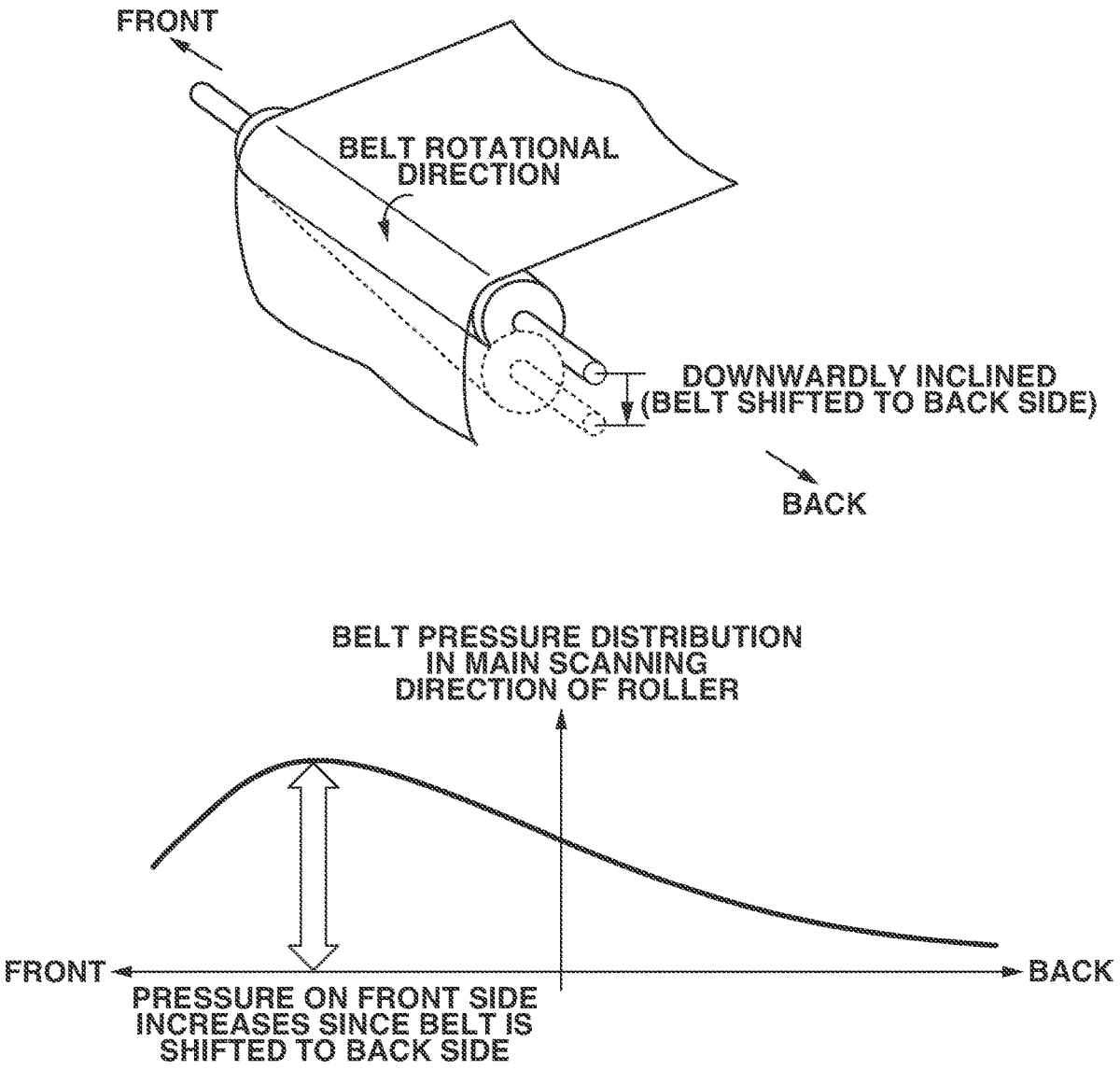
FIG. 13 illustrates an issue in the prior art.

Although, in the above-described exemplary embodiment, the recording material cooling apparatus 50 is disposed in the image forming apparatus 100 as an example (see FIG. 1), it is not limited thereto. For example, the recording material cooling apparatus 50 may be disposed outside the housing of the image forming apparatus 100, as an optional apparatus. More specifically, the recording material cooling apparatus 50 may be supported by an independent frame different from the frame of the image forming apparatus 100. FIG. 12 illustrates a configuration in which the recording material cooling apparatus 50 is disposed outside the image forming apparatus 100. According to the present exemplary embodiment, when an external cooling apparatus 101 is connected to the image forming apparatus 100 as an external apparatus, as illustrated in FIG. 12, the image forming apparatus 100 and the external cooling apparatus 101 are collectively referred to as an image forming apparatus. In other words, according to the present exemplary embodiment, all of apparatuses related to feeding of a sheet to be subjected to image forming to discharging of the sheet to the outside of the apparatus is collectively referred to as an image forming apparatus. When a sheet processing apparatus for performing bookbinding processing and perforation processing on a sheet on the downstream side of the external cooling apparatus 101, the configuration including all of the image forming apparatus 100, the external cooling apparatus 101, and the sheet processing apparatus is referred to as an image forming apparatus for forming an image on a sheet.

The external cooling apparatus 101 illustrated in FIG. 12 is configured to be connectable to the image forming apparatus 100 as one of peripheral devices (referred to as optional units) that can be attached to expand the function of the image forming apparatus 100. The external cooling apparatus 101 is disposed to cool the recording material S discharged from the image forming apparatus 100 and lower the temperature of the recording material S passing through the fixing apparatus 30 to a predetermined temperature or below. The external cooling apparatus 101 includes the above-described recording material cooling apparatus 50 to cool the recording material S. Units included in the image forming apparatus 100 have similar configurations to the configuration in FIG. 1 and are assigned the same reference numerals, and redundant descriptions thereof will be omitted.

The recording materials S cooled by the external cooling apparatus 101 is discharged from the external cooling apparatus 101 by a discharge roller 85, and then is stacked on a discharge tray 120. The discharge tray 120 is disposed detachably attached to the external cooling apparatus 101 and the image forming apparatus 100. More specifically, when the external cooling apparatus 101 is not connected to the image forming apparatus 100, the discharge tray 120 is attached to the image forming apparatus 100 (see FIG. 1). When the external cooling apparatus 101 is to be connected to the image forming apparatus 100, the discharge tray 120 is removed from the image forming apparatus 100 and then attached to the external cooling apparatus 101 by the operator. A plurality of external cooling apparatuses 101 may be connected as peripheral devices. By increasing the number of external cooling apparatuses 101 to be connected, the operator can easily improve the capability of cooling down the recording material S for the existing image forming apparatus 100.

The external cooling apparatus 101 may be connected to the image forming apparatus 100 incorporating the recording material cooling apparatus 50. In addition, other sheet processing apparatuses, such as a curl correction apparatus, may be provided between the image forming apparatus 100 and the external cooling apparatus 101. The sheet processing apparatus may be further connected to the external cooling apparatus 101 on the downstream side of the sheet conveyance direction.

When the present exemplary embodiment is applied to such an image forming apparatus, the steering rollers 501*a* and 502*a* are moved to the reference position when the external cooling apparatus 101 having the recording material cooling apparatus 50 enters the power-off state or the power-saving state. Moving the steering rollers 501*a* and 502*a* to the reference position depending on the power state of the apparatus having the recording material cooling apparatus 50 enables improving the workability in replacing the first belt 501 or the second belt 502. In addition, when power is supplied to the external cooling apparatus 101 via the image forming apparatus 100, the external cooling apparatus 101 enters the power-off state in association with the OFF (power-off) state of the main switch 410 of the image forming apparatus 100. Even in this configuration, the steering rollers 501*a* and 502*a* are moved to the reference position before the image forming apparatus 100 enters the power-off state or the power-saving state, as described above. In this way, moving the steering rollers 501*a* and 502*a* to the reference position depending on the state of the image forming apparatus 100 enables improving the workability in replacing the first belt 501 or the second belt 502 disposed in the recording material cooling apparatus 50 of the external cooling apparatus 101.

Although the above-described exemplary embodiment is configured to perform a similar control on both the steering rollers 501*a* and 502*a* of the first unit 501 U and the second unit 502 U, respectively, the exemplary embodiment may perform this control only on either one unit. For example, the exemplary embodiment may perform the above-described control only on the first unit 501 U in which the moving distance of the steering roller 501*a* toward the inner circumferential side of the first belt 501 is limited because of the existence of the heat sink 503.

Although the above-described exemplary embodiment is configured to nip and convey a recording material S by the first belt 501 and the second belt 502, the second belt 502 may be replaced with a plurality of conveyance rollers. More specifically, the exemplary embodiment may also be configured to form a conveyance nip portion by the first belt 501 in contact with the heat sink 503 on the inner circumferential surface thereof and the conveyance unit having a plurality of conveyance rollers, and to nip and convey the recording material S.

Although the above-described exemplary embodiment is configured to swing the steering rollers 501*a* and 502*a* around the center in the rotational axis direction, the exemplary embodiment may be configured to swing the steering rollers 501*a* and 502*a* around the back side or the front side end in the rotational axis direction. Even in such a configuration, the first belt 501 or the second belt 502 becomes hard to be replaced depending on the swing angles of the rollers in the power-off state. For example, in a configuration in which the steering rollers 501*a* and 502*a* swing around the back side end thereof, when the steering roller 501*a* is swinging so that the front side end of the steering roller 501*a* is separated from the heat sink 503, the first belt 501 becomes hard to be pulled out from the front side. Thus, even in a configuration in which the steering rollers 501*a* and 502*a* swing around an end in the rotational axis direction, moving the steering roller 501*a* or 502*a* back to the angle parallel to other rollers before the image forming apparatus 100 enters the power-off state like the present exemplary embodiment enables improving the workability in replacing the first belt 501 or the second belt 502, respectively.

The image forming apparatus 100 that makes it possible to restores an inclination of a belt to a reference position when power is turned OFF, and to improve the workability in replacing the belt. The present disclosure makes it possible to provide an image forming apparatus having improved workability in replacing a belt of a cooling apparatus.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-128078, filed Jul. 29, 2020, and Japanese Patent Application No. 2021-090149, filed May 28, 2021, each of which is hereby incorporated by reference herein in their entirety.

What is claimed is:

1. An image forming apparatus including an image forming unit configured to form a toner image on a recording material, and configured to perform a state transition to a power-off state and to a standby state where image forming by the image forming unit is possible, the image forming apparatus comprising:

a fixing unit configured to fix the toner image on the recording material;

a belt;

a conveyance unit configured to form a conveyance nip portion with the belt and to nip and convey the recording material that has passed through the fixing unit;

a heat sink configured to be in contact with an inner circumferential surface of the belt;

first and second rollers, each having a rotational axis and are configured to suspend the belt;

a belt position detection unit configured to detect a position of the belt in a widthwise direction perpendicular to a thickness direction of the belt and a conveyance direction of the recording material nipped by the conveyance nip portion;

a steering unit configured to swing the first roller relative to the second roller based on a detection result by the belt position detection unit to widthwisely move the belt relative to the first roller; and a control unit configured to control the steering unit, wherein, when the image forming apparatus enters the power-off state, the control unit controls the steering unit to make the rotational axis of the first roller approximately parallel to the rotational axis of the second roller.

2. The image forming apparatus according to claim 1, wherein the steering unit is configured to swing the first roller around a center of the first roller in the widthwise direction.

3. The image forming apparatus according to claim 1, further comprising a frame configured to support the first roller, the second roller, and the heat sink, wherein the second roller is rotatably fixed to the frame.

4. The image forming apparatus according to claim 1, wherein a state where the rotational axis of the first roller is approximately parallel to the rotational axis of the second roller is a state where an inclination of the rotational axis of the first roller relative to the rotational axis of the second roller is ±0.5° or less.

5. The image forming apparatus according to claim 1, further comprising a switch configured to be turned ON and OFF by a user, wherein, when the switch is turned OFF from ON, the control unit controls the steering unit to make the rotational axis of the first roller approximately parallel to the rotational axis of the second roller, and wherein, after the rotational axis of the first roller is made approximately parallel to the rotational axis of the second roller, the control unit shifts the image forming apparatus to the power-off state.

6. The image forming apparatus according to claim 1, further comprising a steering position detection unit configured to detect a displacement amount of the rotational axis of the first roller relative to a state where the rotational axis of the first roller is approximately parallel to the rotational axis of the second roller, wherein, when the image forming apparatus enters the power-off state, the control unit controls the steering unit to position the first roller at a position where the displacement amount detected by the steering position detection unit is zero.

7. The image forming apparatus according to claim 1, wherein the conveyance unit includes:

another belt configured to nip and convey the recording material together with the belt, a third roller configured to suspend the other belt, a fourth roller configured to suspend the other belt together with the third roller, another belt position detection unit configured to detect a position of the other belt in a rotational axis direction of the third roller, and another steering unit configured to change an angle of a roller, wherein, based on a detection result by the other belt position detection unit, the other steering unit changes an angle of the third roller relative to an angle of the fourth roller to move the other belt toward the rotational axis direction of the third roller relative to the third roller, and wherein, when the image forming apparatus enters the power-off state, the control unit controls the other steering unit to make the rotational axis of the third roller approximately parallel to a rotational axis of the fourth roller.

8. The image forming apparatus according to claim 1, wherein the image forming apparatus is configured to perform a state transition to a power-saving state configured to provide a smaller power consumption than a power consumption of the standby state, and wherein, when the image forming apparatus enters the power-saving state, the control unit controls the steering unit to make the rotational axis of the first roller approximately parallel to the rotational axis of the second roller.

9. The image forming apparatus according to claim 8, wherein, when the image forming unit stops operating for a predetermined time period, the control unit controls the steering unit to make the rotational axis of the first roller approximately parallel to the rotational axis of the second roller, and wherein, after the rotational axis of the first roller is made approximately parallel to the rotational axis of the second roller, the control unit shifts the image forming apparatus to the power-saving state.

10. The image forming apparatus according to claim 8, further comprising an operation unit configured to be operated by a user, wherein, when an instruction for entering the power-saving state is input by the user via the operation unit, the control unit controls the steering unit to make the rotational axis of the first roller approximately parallel to the rotational axis of the second roller, and wherein, after the rotational axis of the first roller is made approximately parallel to the rotational axis of the second roller, the control unit shifts the image forming apparatus to the power-saving state.

11. An image forming apparatus including an image forming unit configured to form a toner image on a recording material, and configured to perform a state transition to a power-off state and to a standby state where image forming by the image forming unit is possible, the image forming apparatus comprising:

a fixing unit configured to fix the toner image on the recording material;

a belt;

a conveyance unit configured to form a conveyance nip portion with the belt and to nip and convey the recording material that has passed through the fixing unit;

a heat sink configured to be in contact with an inner circumferential surface of the belt;

first and second rollers configured to suspend the belt;

a belt position detection unit configured to detect a position of the belt in a widthwise direction perpendicular to a thickness direction of the belt and a conveyance direction of the recording material nipped by the conveyance nip portion;

a steering unit configured to swing the first roller relative to the second roller to widthwisely move the belt relative to the first roller, and to swing the first roller relative to a reference position where the first roller is approximately parallel to the second roller based on a detection result by the belt position detection unit; and a control unit configured to control the steering unit, wherein, when the image forming apparatus enters the power-off state and the first roller is inclined relative to the reference position, the control unit controls the steering unit to position the first roller at the reference position.

* * * * *